US009759460B2

(12) United States Patent
Yamashita et al.

(10) Patent No.: US 9,759,460 B2
(45) Date of Patent: Sep. 12, 2017

(54) AIR-CONDITIONING APPARATUS

(75) Inventors: Koji Yamashita, Tokyo (JP); Takeshi Hatomura, Tokyo (JP); Katsuhiro Ishimura, Tokyo (JP); Shinichi Wakamoto, Tokyo (JP); Naofumi Takenaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 722 days.

(21) Appl. No.: 14/236,339

(22) PCT Filed: Aug. 15, 2012

(86) PCT No.: PCT/JP2012/070771

§ 371 (c)(1),
(2), (4) Date: Jan. 31, 2014

(87) PCT Pub. No.: WO2013/069351

PCT Pub. Date: May 16, 2013

(65) Prior Publication Data

US 2014/0165635 A1 Jun. 19, 2014

(30) Foreign Application Priority Data

Nov. 7, 2011 (WO) ..... PCT/JP2011/006193

(51) Int. Cl.
*F25B 41/00* (2006.01)
*F25B 41/04* (2006.01)
(Continued)

(52) U.S. Cl.
CPC ..... *F25B 30/02* (2013.01); *F25B 13/00* (2013.01); *F25B 49/02* (2013.01);
(Continued)

(58) Field of Classification Search
CPC ..... F25B 13/00; F25B 2313/003; F25B 2313/0231; F25B 2313/02331; F25B 2313/02334; F25B 2313/0292
(Continued)

(56) References Cited

U.S. PATENT DOCUMENTS 3,698,202 A * 10/1972 Missimer ..... F25B 9/006 62/114
3,795,117 A * 3/1974 Moody, Jr. ..... F04C 29/042 62/197
(Continued)

FOREIGN PATENT DOCUMENTS

EP 1795834 * 6/2007
EP 1795834 A2 6/2007
(Continued)

OTHER PUBLICATIONS

Office Action mailed Dec. 2, 2014 issued in corresponding JP patent application No. 2013-542886 (and English translation).
(Continued)

*Primary Examiner* — Henry Crenshaw
(74) *Attorney, Agent, or Firm* — Posz Law Group, PLC

(57) ABSTRACT

A channel on an upstream side of a third expansion device and a channel on an upstream side of a second expansion device are connected during a heating operation, and medium pressure refrigerant generated by the third expansion device during the heating operation is introduced on a suction side of a compressor via the second expansion device and a suction injection pipe.

17 Claims, 15 Drawing Sheets

(51) Int. Cl.

| | |
|---|---|
| ***F25B 27/00*** | (2006.01) |
| ***F25B 13/00*** | (2006.01) |
| ***G05B 15/00*** | (2006.01) |
| ***F25B 29/00*** | (2006.01) |
| ***F25B 30/02*** | (2006.01) |
| ***F25B 49/02*** | (2006.01) |

(52) U.S. Cl.
CPC . *F25B 2313/003* (2013.01); *F25B 2313/0231* (2013.01); *F25B 2313/0272* (2013.01); *F25B 2313/0292* (2013.01); *F25B 2313/0294* (2013.01); *F25B 2313/02331* (2013.01); *F25B 2313/02334* (2013.01); *F25B 2313/02732* (2013.01); *F25B 2313/02741* (2013.01); *F25B 2313/0312* (2013.01); *F25B 2313/0313* (2013.01); *F25B 2313/0314* (2013.01); *F25B 2313/0315* (2013.01); *F25B 2341/0662* (2013.01); *F25B 2600/2513* (2013.01); *F25B 2700/1931* (2013.01); *F25B 2700/21152* (2013.01)

(58) Field of Classification Search
USPC ..... 62/197, 223, 238.6, 324.6; 236/67
See application file for complete search history.

(56) References Cited

U.S. PATENT DOCUMENTS

| | | | | | |
|---|---|---|---|---|---|
| 4,441,335 | A * | 4/1984 | Bonne | F25B 13/00 | 137/563 |
| 4,598,557 | A * | 7/1986 | Robinson | F24D 17/02 | 62/238.6 |
| 4,646,537 | A * | 3/1987 | Crawford | F24D 5/12 | 62/238.6 |
| 4,938,032 | A * | 7/1990 | Mudford | F24F 1/027 | 62/160 |
| 5,319,943 | A * | 6/1994 | Bahel | F24F 1/0003 | 62/156 |
| 5,370,307 | A * | 12/1994 | Uehra | F24F 3/001 | 237/2 B |
| 6,230,506 | B1 * | 5/2001 | Nishida | B60H 1/00907 | 62/160 |
| 2004/0074254 | A1 * | 4/2004 | Hiwata | F25B 9/008 | 62/402 |
| 2004/0200233 | A1 * | 10/2004 | Funakoshi | F25B 1/10 | 62/498 |
| 2005/0262873 | A1 * | 12/2005 | Hirota | F25B 41/04 | 62/503 |
| 2008/0023563 | A1 * | 1/2008 | Tamura | F25B 13/00 | 236/67 |

FOREIGN PATENT DOCUMENTS

| | | | |
|---|---|---|---|
| JP | 54-069859 | A | 6/1979 |
| JP | S56-77658 | A | 6/1981 |
| JP | 61-114058 | A | 5/1986 |
| JP | 02-110255 | A | 4/1990 |
| JP | 05-256525 | A | 10/1993 |
| JP | 07-151413 | A | 6/1995 |
| JP | 2001-311573 | A | 11/2001 |
| JP | 2002-213841 | A | 7/2002 |
| JP | 2005-282972 | A | 10/2005 |
| JP | 2006-138525 | A | 6/2006 |
| JP | 2008-157550 | A | 7/2008 |
| WO | 2010/049998 | A1 | 5/2010 |
| WO | 2011/030407 | A1 | 3/2011 |

OTHER PUBLICATIONS

Japanese Office Action mailed on Jun. 16, 2015 in the corresponding JP Patent application No. 2013-542886. (English translation attached).
Extended European Search Report issued on Jun. 12, 2015 in the corresponding EP Patent application No. 12848436.7.
Office Action dated May 26, 2015 in the corresponding CN application No. 201280047206.9 ( English Translation attached ).
International Search Report of the International Searching Authority mailed Nov. 13, 2012 for the corresponding international application No. PCT/JP2012/070771 (and English translation).
Office Action dated Mar. 27, 2017 issued in corresponding EP patent application No. 12 848 436.7.

* cited by examiner

AIR-CONDITIONING APPARATUS

CROSS REFERENCE TO RELATED APPLICATION

This application is a U.S. national stage application of International Application No. PCT/JP2012/070771 filed on Aug. 15, 2012, which claims priority from, and incorporates by reference, International Application No. PCT/JP2011/006193 filed on Nov. 7, 2011.

TECHNICAL FIELD

The present invention relates to an air conditioning apparatus applied to a multi-air-conditioning system for a building, for example.

BACKGROUND ART

Among air conditioning apparatus, there is proposed one equipped with an outdoor unit, a relay unit, and indoor units such as in a multi air conditioning system for a building, in which the outdoor unit and the relay unit are connected by refrigerant pipes in which refrigerant circulates, and in which the relay unit and the indoor units are connected by heat medium pipes in which a heat medium circulates (see Patent Literature 1, for example). With the technology described in Patent Literature 1, the outdoor unit and the indoor units are connected via a relay unit including an intermediate heat exchanger that induces heat exchange between refrigerant and heat medium, thereby enabling a reduction in the transport power of the refrigerant as well as the transport performance of the heat medium. Also, with the technology described in Patent Literature 1, the relay unit includes multiple intermediate heat exchangers and multiple flow switching devices, thereby enabling cooling and heating mixed operation to be carried out.

Also, there is proposed a refrigeration device that, in order to lower the discharge temperature of a compressor and thereby cause the compressor to operate stably, irrespective of a refrigerant circuit, operating state, or the like, a refrigerant pipe carrying high-pressure liquid refrigerant is connected to an intermediate pressure unit of the compressor, and liquid injection into the compressor is conducted (see Patent Literature 2, for example).

Furthermore, there is proposed an air conditioning device that includes a refrigerant circuit in which a check valve is connected in parallel with an expansion device provided on the indoor side, and in addition, a check valve is also connected in parallel with an expansion device on the outdoor side (see Patent Literature 3, for example). With this refrigerant circuit, the technology described in Patent Literature 3 enables high-pressure liquid refrigerant to be supplied to a pipe connecting the suction side of the compressor to an accumulator, and injected into the compressor, even if the flow of refrigerant changes due to switching between cooling operation and heating operation.

CITATION LIST

Patent Literature

Patent Literature 1: International Publication No. WO10/049,998 (see FIG. 1, for example)

Patent Literature 2: Japanese Unexamined Patent Application Publication No. 2005-282972 (see pgs. 3-4 and FIG. 1, for example)

Patent Literature 3: Japanese Unexamined Patent Application Publication No. 2-110255 (see pgs. 3-4 and FIG. 1, for example)

SUMMARY OF INVENTION

Technical Problem

Since the technology described in Patent Literature 1 does not carry out injection in the first place, during heating operation with a low outside air temperature in the case of using the R32 as the operating refrigerant or the like, for example, there is a possibility that the discharge temperature of the compressor will become too high, degrading the refrigerant and refrigerating machine oil, and lowering the operating stability of the air conditioning apparatus.

Since the technology described in Patent Literature 2 is technology that injects high-pressure liquid refrigerant into the compressor of a refrigeration device, there is a problem of being unable to deal with the case of changing the flow of refrigerant, such as when switching from cooling operation to heating operation, cooling and heating mixed operation, or the like, for example.

The technology described in Patent Literature 3 is unable to conduct injection with respect to an indoor unit for which a check valve is not connected to an expansion device on the outdoor unit side, and its general applicability suffers.

The present invention resolves at least one of the above problems, and takes as an object to provide an air conditioning apparatus that enables improved operating stability by lowering the discharge temperature of a compressor, irrespective of operating mode.

Solution to Problem

In an air conditioning apparatus according to the present invention, an air conditioning apparatus is provided wherein a compressor including a compression chamber inside a hermetically sealed container thereof, a first refrigerant flow switching device, a first heat exchanger, at least one first expansion device, and at least one second heat exchanger are connected by refrigerant pipes to form a circuit constituting a refrigeration cycle. The air-conditioning apparatus comprises an accumulator for accumulating excess refrigerant provided on a channel on a suction side of the compressor, a suction injection pipe for externally introducing refrigerant in a liquid or a two-phase state into a channel between the compressor and the accumulator, and a second expansion device provided to the suction injection pipe. Tthe air-conditioning apparatus is able to perform a heating operation, in which at least low pressure refrigerant flows into the first heat exchanger to cause it to serve as an evaporator, and high pressure refrigerant flows into some or all of the at least one second heat exchanger to cause them to serve as at least one condenser. The air conditioning apparatus comprises a third expansion device that generates a medium pressure smaller than the high pressure and larger than the low pressure during the heating operation in a channel of refrigerant from the at least one second heat exchanger to the first heat exchanger during the heating operation. A channel on an upstream side of the third expansion device and a channel on an upstream side of the second expansion device are connected during the heating operation, and the medium pressure refrigerant generated by the third expansion device during the heating operation is introduced on a suction side of the compressor via the second expansion device and the suction injection pipe.

Advantageous Effects of Invention

According to an air conditioning apparatus in accordance with the present invention, by suction injection from a suction injection pipe, it is possible to moderate increase in the temperature of refrigerant discharged from a compressor, irrespective of operating mode, and thus it is possible to moderate degradation of refrigerant and refrigerating machine oil, and improve operating stability.

DESCRIPTION OF EMBODIMENTS

Embodiment 1

Figure 1:
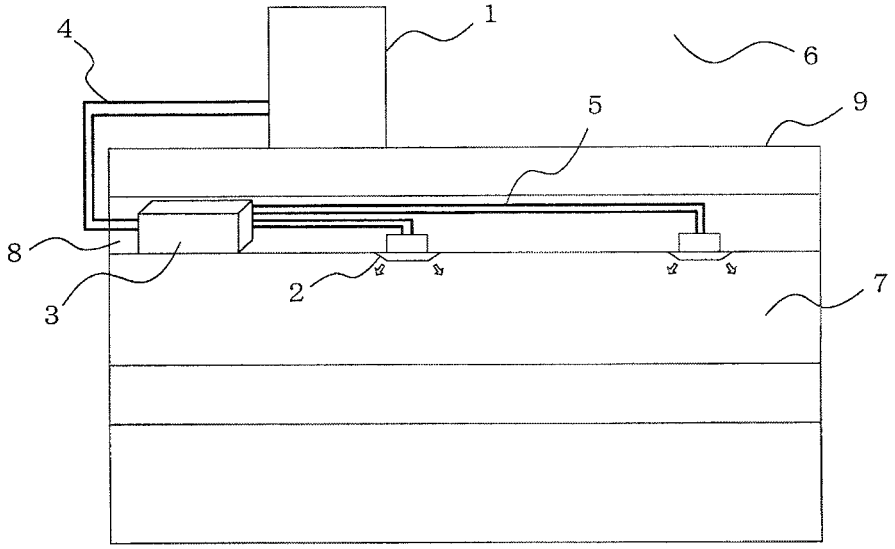
FIG. 1 is a schematic diagram illustrating an exemplary installation of an air conditioning apparatus according to Embodiment 1 and Embodiment 2 of the present invention.

Embodiment 1 of the present invention will be described on the basis of the drawings. FIG. 1 is a schematic diagram illustrating an exemplary installation of an air conditioning apparatus according to Embodiment 1. An exemplary installation of the air conditioning apparatus will be described on the basis of FIG. 1. With the present air conditioning apparatus, each indoor unit is able to freely select a cooling mode or a heating mode as the operating mode by utilizing refrigeration cycles (a refrigerant circuit A and a heat medium circuit B) that circulate refrigerant and heat medium. Note that, in the drawings hereinafter, including FIG. 1, the relative sizes of respective structural members may differ from actual sizes in some cases.

In FIG. 1, an air conditioning apparatus according to Embodiment 1 is equipped with one outdoor unit 1 which is the heat source unit, multiple indoor units 2, and a heat medium relay unit 3 interposed between the outdoor unit 1 and the indoor units 2. The heat medium relay unit 3 exchanges heat between refrigerant (heat source side refrigerant) and heat medium. The outdoor unit 1 and the heat medium relay unit 3 are connected by refrigerant pipes 4 that conduct refrigerant. The heat medium relay unit 3 and the indoor units 2 are connected by pipes (heat medium pipes) 5 that conduct the heat medium. Also, cooling energy or heating energy generated at the outdoor unit 1 is delivered to the indoor units 2 via the heat medium relay unit 3.

The outdoor unit 1 is ordinarily placed in an outdoor space 6, which is a space outside a building or other structure 9 (such as the roof, for example), and provides cooling energy or heating energy to the indoor units 2 via the heat medium relay unit 3. The indoor units 2 are disposed at positions able to supply cooled air or heated air to an indoor space 7, which is a space inside the structure 9 (such as a room, for example), and provide cooled air or heated air to the indoor space 7 to be air-conditioned. The heat medium relay unit 3 is configured in a separate casing from the outdoor unit 1 and the indoor units 2 able to be installed in a separate location from the outdoor space 6 and the indoor space 7, is connected to the outdoor unit 1 and the indoor units 2 by the refrigerant pipes 4 and the pipes 5, respectively, and conveys cooling energy or heating energy supplied from the outdoor unit 1 to the indoor units 2.

As illustrated in FIG. 1, in an air conditioning apparatus according to Embodiment 1, the outdoor unit 1 and the heat medium relay unit 3 are connected using two refrigerant pipes 4, while the heat medium relay unit 3 and each of the indoor units 2 are connected by two pipes 5. In this way, by using two pipes (the refrigerant pipes 4 and the pipes 5) to connect each unit (the outdoor unit 1, the indoor units 2, and the heat medium relay unit 3) in the air conditioning apparatus according to Embodiment 1, construction becomes easy.

Note that FIG. 1 illustrates, as an example, a state in which the heat medium relay unit 3, although inside the structure 9, is installed in a space which is a separate space from the indoor space 7, such as above the ceiling (hereinafter simply designated the space 8). The heat medium relay unit 3 is otherwise installable in a shared space containing an elevator or the like. Also, although FIGS. 1 and 2 illustrate the case in which the indoor units 2 are ceiling cassettes as an example, the configuration is not limited thereto, and the indoor units 2 may be of any type, such as ceiling-concealed or ceiling-hung units, insofar as the indoor units 2 are able to expel heated air or cooled air into the indoor space 7 directly or via means such as ducts.

Although FIG. 1 illustrates the case of the outdoor unit 1 being installed in the outdoor space 6 as an example, the configuration is not limited thereto. For example, the outdoor unit 1 may also be installed in an enclosed space such as a ventilated machine room, and may be installed inside the structure 9 insofar as waste heat can be exhausted outside the structure 9 by an exhaust duct. Alternatively, the outdoor unit 1 may be installed inside the structure 9 using a water-cooled outdoor unit 1. Installing the outdoor unit 1 in any such location is not particularly problematic.

It is also possible to install the heat medium relay unit 3 near the outdoor unit 1. However, the heat medium pumping power will be very large if the distance from the heat medium relay unit 3 to the indoor units 2 is too long, and thus care must be taken not to squander the energy-saving advantages. Furthermore, the number of connected outdoor units 1, indoor units 2, and heat medium relay units 3 is not limited to the numbers illustrated in FIGS. 1 and 2, and it is sufficient to determine numbers according to the structure 9 where the air conditioning apparatus according to Embodiment 1 is installed.

Figure 2:
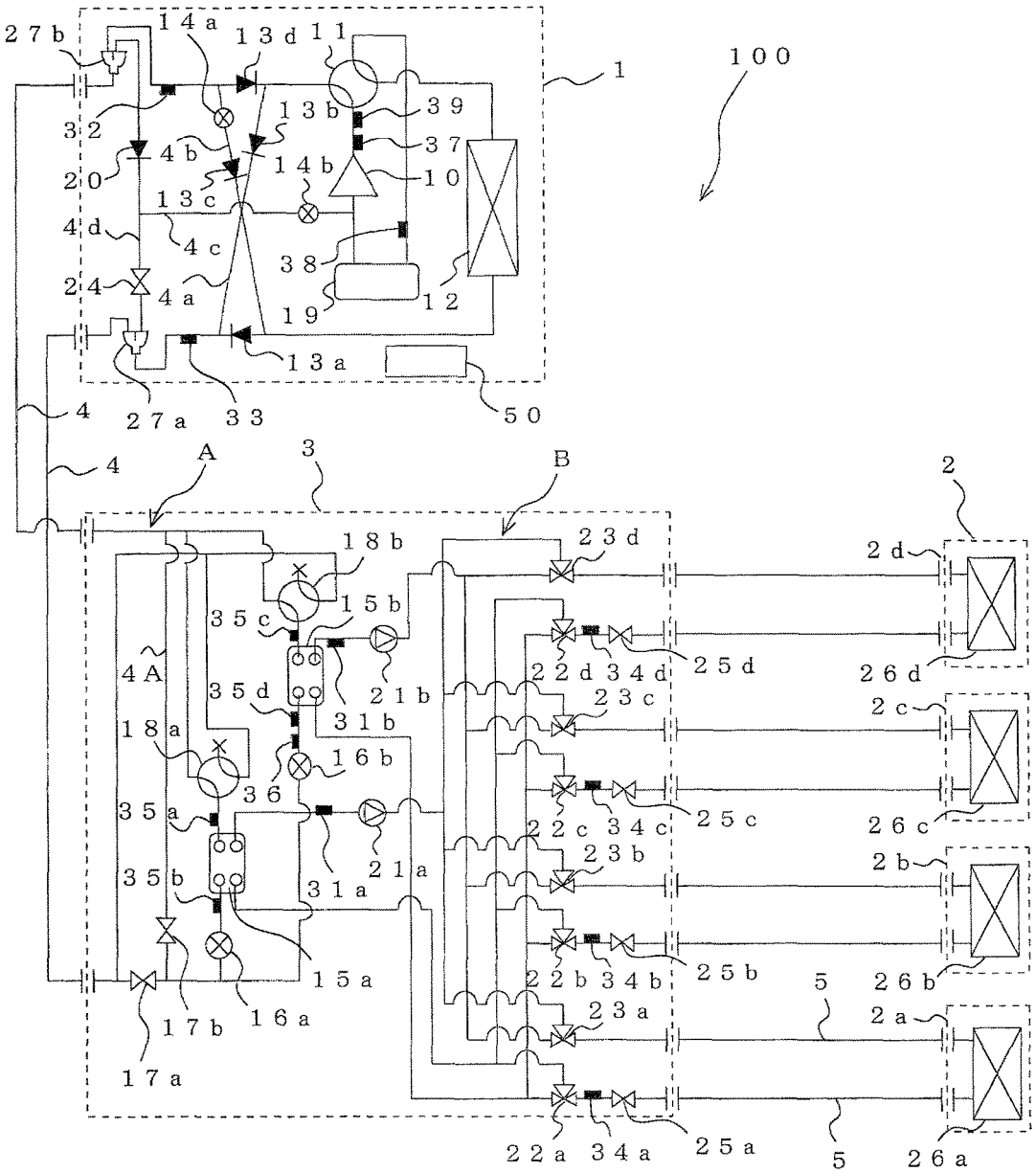
FIG. 2 is an exemplary circuit layout of an air conditioning apparatus according to Embodiment 1 of the present invention.
Figure 11:
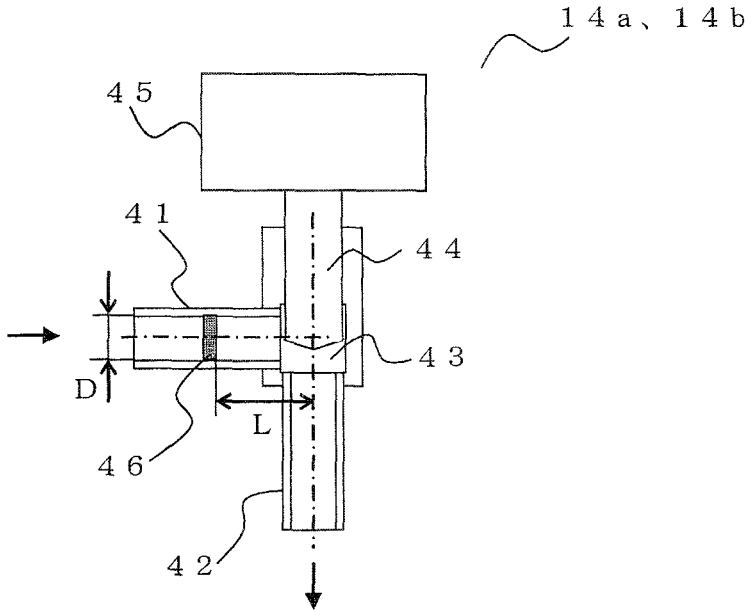
FIG. 11 is a schematic diagram illustrating a configuration of an expansion device in an air conditioning apparatus according to Embodiment 1 and Embodiment 2 of the present invention.

FIG. 2 is an exemplary circuit layout of an air conditioning apparatus (hereinafter referred to as the air conditioning apparatus 100) according to Embodiment 1. FIG. 11 is a schematic diagram of a configuration of an expansion device 14 in an air conditioning apparatus 100 according to Embodiment 1. A detailed configuration of the air conditioning apparatus 100 will be described on the basis of FIGS. 2 and 11. As illustrated in FIG. 2, the outdoor unit 1 and the heat medium relay unit 3 are connected by refrigerant pipes 4 via an intermediate heat exchanger 15*a* and an intermediate heat exchanger 15*b* provided in the heat medium relay unit 3. Also, the heat medium relay unit 3 and the indoor units 2 are likewise connected by the pipes 5 via the intermediate heat exchanger 15*a* and the intermediate heat exchanger 15*b*. Note that the refrigerant pipes 4 will be further discussed at a later stage.

The air conditioning apparatus 100 includes a refrigerant circuit A, which is a refrigeration cycle that circulates refrigerant, as well as a heat medium circuit B that circulates head medium. Each of the indoor units 2 is able to select between cooling operation and heating operation. Additionally, it is possible to conduct a cooling only operating mode in which all operating indoor units 2 execute cooling operation, a heating only operating mode in which all indoor units 2 execute heating operation, and a cooling and heating mixed operating mode, which is a mode having a mix of indoor units executing cooling operation and heating operation. Note that the cooling and heating mixed operating mode includes a cooling main operating mode in which the cooling load is greater, and a heating main operating mode in which the heating load is greater. The cooling only operating mode, the heating only operating mode, the cooling main operating mode, and the heating main operating mode will be described in detail with the description of FIGS. 3 to 10.

[Outdoor Unit 1]

The outdoor unit 1 is equipped with a compressor 10, a first refrigerant flow switching device 11 such as a four-way valve, a heat source side heat exchanger 12, and an accumulator 19, which are connected in series by the refrigerant pipes 4. The outdoor unit 1 is also provided with a first connecting pipe 4*a*, a second connecting pipe 4*b*, a check valve 13*a*, a check valve 13*b*, a check valve 13*c*, and a check valve 13*d*. Furthermore, the outdoor unit 1 is equipped with a branching unit 27*a*, a branching unit 27*b*, an opening/closing device 24, a backflow prevention device 20, an expansion device 14*a*, an expansion device 14*b*, a medium pressure detection device 32, a discharge refrigerant temperature detection device 37, a high pressure detection device 39, a suction injection pipe 4*c*, a branch pipe 4*d*, and a controller 50.

The compressor 10 suctions refrigerant and compresses the refrigerant to a high temperature, high pressure state. The compressor 10 may be configured as a variable-capacity inverter compressor or the like, for example. The discharge side of the compressor 10 is connected to the first refrigerant flow switching device 11, while the suction side thereof is connected to the suction injection pipe 4*c* and the accumulator 19. The compressor 10 also includes a compression chamber inside a hermetically sealed container, and is a low-pressure shell-type compressor in which the inside of the hermetically sealed container is in a low-pressure refrigerant pressure environment that suctions and compresses low-pressure refrigerant inside the hermetically sealed container into the compression chamber. In addition, the compressor 10 is connected to the suction injection pipe 4*c* connected to the refrigerant pipe 4 between the suction side of the compressor 10 and the accumulator 19, making it possible to inject high pressure or medium pressure refrigerant on the suction side of the compressor 10.

In the lower part of the compressor 10, refrigerant and oil (refrigerating machine oil) flowing in from the suction side of the compressor 10 is able to flow. Also, the compressor 10 includes a middle part where a motor is disposed, in which refrigerant flowing in from the lower part of the compressor 10 is compressed. Furthermore, in the upper part of the compressor 10, a discharge chamber made up of a hermetically sealed container is provided, making it possible to discharge refrigerant and oil compressed in the middle part. In this way, the compressor 10 includes a portion exposed to high temperature and high pressure refrigerant in the upper part of the compressor 10, and a portion exposed to low temperature and low pressure refrigerant as in the lower part of the compressor 10, and thus the temperature of the hermetically sealed container constituting the compressor 10 becomes an intermediate temperature therebetween. Note that while the compressor 10 is operating, the motor generates heat due to an electric current supplied to the motor in the middle part. Consequently, the low temperature and low pressure gas-liquid two-phase refrigerant suctioned into the compressor 10 is heated by the hermetically sealed container and the motor of the compressor 10.

The first refrigerant flow switching device 11 switches between a flow of refrigerant during heating operation (during the heating only operating mode and during the heating main operating mode discussed later) and a flow of refrigerant during cooling operation (during the cooling only operating mode and during the cooling main operating mode discussed later). Note that FIG. 2 illustrates a state in which the first refrigerant flow switching device 11 is connected to the discharge side of the compressor 10 and the first connecting pipe 4*a*, and additionally connected to the heat source side heat exchanger 12 and the accumulator 19. The heat source side heat exchanger 12 functions as an evaporator during heating operation, functions as a condenser (or radiator) during cooling operation, and exchanges heat between the refrigerant and air supplied from an air-sending device such as a fan (not illustrated), causing that refrigerant to evaporate and gasify or condense and liquefy. One side of the heat source side heat exchanger 12 is connected to the first refrigerant flow switching device 11, while the other side is connected to the refrigerant pipe 4 on which the check valve 13*a* is provided. The accumulator 19 is provided on the suction side of the compressor 10, and accumulates excess refrigerant. One side of the accumulator 19 is connected to the first refrigerant flow switching device 11, while the other side is connected to the suction side of the compressor 10.

The check valve 13*a* is provided on a refrigerant pipe 4 between the heat source side heat exchanger 12 and the heat medium relay unit 3, and allows the flow of refrigerant only in a designated direction (the direction from the outdoor unit 1 to the heat medium relay unit 3). The check valve 13*b* is provided on the first connecting pipe 4*a*, and causes refrigerant discharged from the compressor 10 during heating operation to flow to the heat medium relay unit 3. The check valve 13*c* is provided on the second connecting pipe 4*b*, and causes refrigerant returning from the heat medium relay unit 3 during heating operation to flow to the suction side of the compressor 10. The check valve 13*d* is provided on a refrigerant pipe 4 between the heat medium relay unit 3 and the first refrigerant flow switching device 11, and allows the flow of refrigerant only in a designated direction (the direction from the heat medium relay unit 3 to the outdoor unit 1).

The first connecting pipe 4*a* connects, inside the outdoor unit 1, the refrigerant pipe 4 between the first refrigerant flow switching device 11 and the check valve 13*d*, and the refrigerant pipe 4 between the check valve 13*a* and the heat medium relay unit 3.

The second connecting pipe 4*b* connects, inside the outdoor unit 1, the refrigerant pipe 4 between the check valve 13*d* and the heat medium relay unit 3, and refrigerant pipe 4 between the heat source side heat exchanger 12 and the check valve 13*a*. By providing the first connecting pipe 4*a*, the second connecting pipe 4*b*, and the check valves 13*a* to 13*d*, it is possible to keep the flow of refrigerant flowing into the heat medium relay unit 3 going in a fixed direction, regardless of the operation requested by the indoor units 2.

The two branching units 27 (branching unit 27*a*, branching unit 27*b*) cause inflowing refrigerant to branch. The refrigerant inflow side of the branching unit 27*a* is connected to the refrigerant pipe 4 on which the check valve 13*a* is provided, while one end thereof on the refrigerant outflow side is connected to the refrigerant pipe 4 that connects the outdoor unit 1 and the heat medium relay unit 3, and the other end on the refrigerant outflow side is connected to the branch pipe 4*d*. Also, the refrigerant inflow side of the branching unit 27*b* is connected to the refrigerant pipe 4 that connects the heat medium relay unit 3 and the outdoor unit 1, while one end of the refrigerant outflow side is connected to the refrigerant pipe 4 on which the check valve 13*d* is provided and the second connecting pipe 4*b*, and the other end of the refrigerant outflow side is connected to the branch pipe 4*d*. Note that the branching units 27 may be made up of Y-junctions, T-junctions, or the like, for example.

Liquid refrigerant or gas-liquid two-phase refrigerant flows into the branching units 27, depending on the operating mode of the air conditioning apparatus 100. For example, in the case of the cooling only operating mode, gas refrigerant flows into the branching unit 27*b*. In the case of the cooling main operating mode, gas-liquid two-phase refrigerant flows into the branching unit 27*a*, while gas refrigerant flows into the branching unit 27*b*. In the case of the heating only operating mode and the heating main operating mode, gas-liquid two-phase refrigerant flows into the branching unit 27*b*. Accordingly, in order to equally distribute the gas-liquid two-phase refrigerant, the branching units 27 are structured so as to split the flow of refrigerant in a configuration state such that refrigerant branches in two after flowing from bottom to top. In other words, take the refrigerant inflow side of the branching units 27 to be the lower side (lower in the gravitational direction), and take the refrigerant outflow sides of the branching units 27 (both sides) to be the upper side (upper in the gravitational direction). In so doing, gas-liquid two-phase refrigerant flowing into the branching units 27 may be equally distributed, and it is possible to moderate reductions in the air conditioning performance of the air conditioning apparatus 100.

The opening/closing device 24 opens and closes the channel between the branching unit 27*a* and the suction injection pipe 4*c*. The opening/closing device 24 opens in the case of injecting in the cooling only operating mode and in the case of injecting in the cooling main operating mode, and closes in the case of not injecting. In addition, the opening/closing device 24 closes in the heating only operating mode and the heating main operating mode. The opening/closing device 24 is provided on the branch pipe 4*d*, with one end thereof connected to the branching unit 27*a*, and the other end thereof connected to the suction injection pipe 4*c*. Note that the opening/closing device 24 may be anything capable of switching a channel open/closed, such as a solenoid valve capable of open/close switching, an electronic expansion valve capable of varying an aperture area, or the like.

The backflow prevention device 20 causes the refrigerant flow from the branching unit 27*b* to the suction injection pipe 4*c* in the case of injecting in the heating only operating mode and the case of injecting in the heating main operating mode. Note that the backflow prevention device 20 closes in the case of injecting in the cooling only operating mode and the case of injecting in the cooling main operating mode. Note that although FIG. 2 illustrates the case in which the backflow prevention device 20 is a check valve as an example, a solenoid valve capable of open/close switching, an electronic expansion valve capable of varying an aperture area, or the like is also acceptable.

The medium pressure detection device 32 detects the pressure of refrigerant flowing between the branching unit 27*b* and the expansion device 14*a*. In other words, the medium pressure detection device 32 detects the pressure of medium pressure refrigerant that was depressurized by the expansion devices 16 of the heat medium relay unit 3 and returned to the outdoor unit 1. The medium pressure detection device 32 is provided between the branching unit 27*b* and the expansion device 14*a*. The high pressure detection device 39 detects the pressure of refrigerant that was pressurized by the compressor 10 and reached high pressure. The high pressure detection device 39 is provided on the refrigerant pipe 4 connected on the discharge side of the compressor 10. The medium pressure detection device 32 and the high pressure detection device 39 may be pressure sensors, but may also be made up of temperature sensors. In other words, it is also possible to enable the controller 50 to compute a medium pressure by computation on the basis of a detected temperature.

The discharge refrigerant temperature detection device 37 detects the temperature of refrigerant discharged from the compressor 10, and is provided on the refrigerant pipe 4 connected on the discharge side of the compressor 10.

A suction refrigerant temperature detection device 38 detects the temperature of refrigerant flowing into the compressor 10, and is provided on the refrigerant pipe 4 on the upstream side of the accumulator 19.

A branch refrigerant temperature detection device 33 detects the temperature of refrigerant flowing into the branching unit 27*a*, and is provided in the channel on the inflow side of the branching unit 27*a*.

The two expansion devices 14 (expansion device 14*a*, expansion device 14*b*) have the function of a pressure-reducing valve or an expansion valve, dropping the pressure to cause refrigerant to expand. The expansion device 14*a* is provided on the second connecting pipe 4*b* (the channel leading from the branching unit 27*b* to the heat source side heat exchanger 12 in the heating only operating mode and the heating main operating mode discussed later), and is provided on the downstream side of the check valve 13*c*. Meanwhile, the expansion device 14*b* is provided on the suction injection pipe 4*c*. Two-phase gas-liquid refrigerant flows into the expansion device 14*a* in the case of the heating only operating mode and the heating main operating mode. Meanwhile, liquid refrigerant flows into the expansion device 14*b* during the cooling only operating mode, whereas refrigerant in a two-phase gas-liquid state flows into the expansion device 14*b* in the case of the cooling main operating mode, the heating only operating mode, and the heating main operating mode.

The expansion device 14*a* may be configured as an electronic expansion valve that is capable of varying an aperture area. If the expansion device 14*a* is configured with an electronic expansion valve, it is possible to control the pressure on the upstream side of the expansion device 14*a* to an arbitrary pressure. Note that the expansion device 14*a* is not limited to an electronic expansion valve, and although controllability suffers slightly, compact solenoid valves or the like may also be combined to enable selecting from multiple aperture areas, or configured as a capillary tube such that a medium pressure is formed according to refrigerant pressure loss.

Also, the expansion device 14*b* likewise may be configured as an electronic expansion valve that is capable of varying an aperture area. In the case of injecting, this expansion device 14*b* controls the aperture area of the expansion device 14*b* such that the discharge temperature of the compressor 10 detected by the discharge refrigerant temperature detection device 37 does not become too high.

In the case of configuring the expansion devices 14 with electronic expansion valves, if refrigerant in a two-phase gas-liquid state flows into the expansion devices 14, a state of gas flowing into the expansion part of the expansion devices 14 and a state of liquid flowing in occur separately (separation between gas refrigerant and liquid refrigerant occurs), and the pressure on the outlet side of the expansion devices 14 may not be stable. The separation of gas refrigerant and liquid refrigerant occurs particularly in the case where the quality of the refrigerant is low, and there is a strong tendency for the pressure to become unstable. Accordingly, the expansion devices 14 are equipped with a configuration like the following.

As illustrated in FIG. 11, the expansion devices 14 include an inflow pipe 41, an outflow pipe 42, an expansion part (medium pressure refrigerant expansion part, injection refrigerant expansion part) 43, a valve body 44, a motor 45, and a mixing device (medium pressure refrigerant mixing device, injection refrigerant mixing device) 46. The inflow pipe 41 is formed in an approximately cylindrical shape, for example, and guides refrigerant flowing in from the inflow pipe 41 to the expansion part 43. The outflow pipe 42 is formed in an approximately cylindrical shape, for example, and is also provided intersecting the inflow pipe 41, and guides refrigerant depressurized by the expansion part 43 outside the expansion device 14. The expansion part 43 is a member that depressurizes refrigerant, and communicates with the inflow pipe 41 and the outflow pipe 42. The valve body 44 is provided in the expansion part 43, and causes refrigerant flowing into the expansion part 43 to depressurize. The motor 45 adjusts the position of the valve body 44 by rotating the valve body 44, and changes the expansion amount of the expansion part 43. Note that the motor 45 is controlled by the controller 50. The mixing device 46 nearly uniformly mixes gas refrigerant and liquid refrigerant among the refrigerant flowing in from the inflow pipe 41.

In this way, since the expansion devices 14 have the above configuration, inflowing gas refrigerant and liquid refrigerant are mixed and then depressurized, thereby making it possible to moderate the separation of gas refrigerant and liquid refrigerant, and stabilize the pressure.

Note that the mixing device 46 may be anything capable of creating a state in which gas refrigerant and liquid refrigerant are nearly uniformly intermixed. Accordingly, the mixing device 46 may be made up of a metal foam, for example. The metal foam referred to herein is a metal with a porous body having a three-dimensional mesh structure that is the same as a resin foam such as a sponge, and having the greatest porosity (void ratio) among metal porous bodies (80% to 97%). When liquid refrigerant is made to flow through such a metal foam, gas among the liquid refrigerant is finely distributed and mixed due to the effects of the three-dimensional mesh structure, which exhibits the effect of enabling uniform intermixing of the gas refrigerant and the liquid refrigerant.

Also, take D to be the inner diameter of the inflow pipe 41, and L to be the length from the center axis of the outflow pipe 42 to the mixing device 46. When the value of D is fixed and the value of L is varied, the field of fluid dynamics demonstrates that if refrigerant flows over a length such that the value of L/D becomes 8 to 10, the effects caused by the mixing (the disturbance produced) by the mixing device 46 disappear, and separation between gas refrigerant and liquid refrigerant occurs. Accordingly, the mixing device 46 may be provided at a position such that L/D becomes 6 or less. With this configuration, liquid refrigerant mixed by the mixing device 46 reaches the expansion part 43 while still in a mixed state, thus making it possible to more fully moderate the destabilization of pressure.

The suction injection pipe 4*c* is a pipe through which refrigerant flows in the case of injection into the compressor 10. One end of the suction injection pipe 4*c* is connected to the branch pipe 4*d*, while the other end is connected to the refrigerant pipe 4 that connects the accumulator 19 and the compressor 10. The expansion device 14*b* is provided on the suction injection pipe 4*c*.

The branch pipe 4*d* is a pipe for leading refrigerant to the suction injection pipe 4*c* in the case of injection into the compressor 10. The branch pipe 4*d* is connected to the branching unit 27*a*, the branching unit 27*b*, and the suction injection pipe 4*c*. The backflow prevention device 20 and the opening/closing device 24 are provided on the branch pipe 4*d*.

The controller 50 is made up of a microcontroller or the like, and conducts control on the basis of detected information from various detection devices as well as instructions from a remote control. Besides controlling the actuators discussed earlier, the controller 50 is configured to control the driving frequency of the compressor 10, the rotation speed of the air-sending device provided to the heat source side heat exchanger 12 (including ON/OFF), the opening and closing of the opening/closing device 24, the opening degree (expansion amount) of the expansion device 14, the switching of the first refrigerant flow switching device 11, and various equipment provided in the heat medium relay unit 3 and the indoor units 2, and to execute the respective operating modes discussed later.

During the cooling only operating mode and the cooling main operating mode, the controller 50 is able to control the flow rate of refrigerant to inject by opening the opening/closing device 24 and adjusting the opening degree of the expansion device 14*b*. Also, during the heating only operating mode and the heating main operating mode, the controller 50 is able to control the flow rate of refrigerant to inject by closing the opening/closing device 24 and adjusting the opening degrees of the expansion device 14*a* and the expansion device 14*b*. Then, by injecting into the compressor 10, it is possible to reduce the temperature of refrigerant discharged from the compressor 10. Note that specific control operations will be described in the operational description of each operating mode discussed later.

Note that in the case of injecting, control of the temperature of discharge from the expansion device 14*b* stabilizes if, for the expansion device 14*a*, the controller 50 controls the opening degree of the expansion device 14*a* such that the medium pressure detected by the medium pressure detection device 32 becomes a predetermined value (target value) during the heating only operating mode and the heating main operating mode.

More specifically, control of the temperature of discharge from the expansion device 14*b* stabilizes if the controller 50 controls the opening degree of the expansion device 14*a* such that the detected pressure of the medium pressure detection device 32 or the saturation pressure of the detected temperature of the medium pressure detection device 32, or alternatively, the detected temperature of the medium pressure detection device 32 or the saturation temperature of the detected pressure of the medium pressure detection device 32, reaches a predetermined value (target value) or is within a target range.

Also, in the case of injecting, for the expansion device 14*b* the controller 50 may control the aperture area of the expansion device 14*b* such that the discharge temperature of the compressor 10 detected by the discharge refrigerant temperature detection device 37 does not become too high.

More specifically, upon determining that the discharge temperature has exceeded a predetermined value (such as 110 degrees C., for example), the expansion device 14*b* may be controlled to open by a fixed opening degree, such as 10 pulses each, for example, or the opening degree of the expansion device 14*b* may be controlled such that the discharge temperature becomes a target value (100 degrees C., for example), or controlled such that the discharge temperature becomes less than or equal to a target value (100 degrees C., for example), or controlled such that the discharge temperature is within a target range (between 90 degrees C. to 100 degrees C., for example). Furthermore, the controller 50 may also be configured to compute a degree of discharge superheat of the compressor 10 from the detected temperature of the discharge refrigerant temperature detection device 37 and the detected pressure of the high pressure detection device 39, and control the opening degree of the expansion device 14*b* such that the degree of discharge superheat becomes a target value (40 degrees C., for example), or be controlled such that the degree of discharge superheat becomes less than or equal to a target value (40 degrees C., for example), or is controlled such that the degree of discharge superheat is within a target range (between 20 degrees C. and 40 degrees C., for example).

[Indoor Units 2]

Each of the indoor units 2 is equipped with a use side heat exchanger 26. The use side heat exchangers 26 are connected to heat medium flow control devices 25 and second heat medium flow switching devices 23 of the heat medium relay unit 3 by the pipes 5. The use side heat exchangers 26 exchange heat between heat medium and air supplied from an air-sending device such as a fan (not illustrated), and generate heated air or cooled air to supply to the indoor space 7.

FIG. 2 illustrates a case in which four indoor units 2 are connected to the heat medium relay unit 3 as an example, these being indicated as an indoor unit 2*a*, an indoor unit 2*b*, an indoor unit 2*c*, and an indoor unit 2*d* from the bottom of the page. Also, the use side heat exchangers 26 are indicated as a use side heat exchanger 26*a*, a use side heat exchanger 26*b*, a use side heat exchanger 26*c*, and a use side heat exchanger 26*d* from the bottom of the page, in correspondence with the indoor unit 2*a* to the indoor unit 2*d*. Note that, similarly to FIG. 1, the number of connected indoor units 2 is not limited to the four illustrated in FIG. 2.

[Heat Medium Relay Unit 3]

The heat medium relay unit 3 is equipped with two intermediate heat exchangers 15, two expansion devices 16, two opening/closing devices 17, two second refrigerant flow switching devices 18, two pumps 21, four first heat medium flow switching devices 22, four second heat medium flow switching devices 23, and four heat medium flow control devices 25.

The two intermediate heat exchangers 15 (intermediate heat exchanger 15*a*, intermediate heat exchanger 15*b*) function as condensers (radiators) or evaporators, exchanging heat between refrigerant and heat medium, and transferring cooling energy or heating energy generated by the outdoor unit 1 and stored in the refrigerant to the heat medium. The intermediate heat exchanger 15*a* is provided between the expansion device 16*a* and the second refrigerant flow switching device 18*a* on the refrigerant circuit A, serving to cool the heat medium during the cooling only operating mode, heat the heat medium during the heating only operating mode, and cool the heat medium during the cooling and heating mixed operating mode. Meanwhile, the intermediate heat exchanger 15*b* is provided between the expansion device 16*b* and the second refrigerant flow switching device 18*b* on the refrigerant circuit A, serving to cool the heat medium during the cooling only operating mode, heat the heat medium during the heating only operating mode, and heat the heat medium during the cooling and heating mixed operating mode.

The two expansion devices 16 (expansion device 16*a*, expansion device 16*b*) have the function of a pressure-reducing valve or an expansion valve, depressurizing the refrigerant to cause it to expand. The expansion device 16*a* is provided on the upstream side of the intermediate heat exchanger 15*a* with respect to the flow of the refrigerant during cooling operation. The expansion device 16*b* is provided on the upstream side of the intermediate heat exchanger 15*b* with respect to the flow of the refrigerant during cooling operation. The two expansion devices 16 may have variably controllable opening degrees, and may be configured as an electronic expansion valve or the like, for example.

The two opening/closing devices 17 (opening/closing device 17*a*, opening/closing device 17*b*) are made up of a two-way valve or the like, opening and closing the refrigerant pipes 4. The opening/closing device 17*a* is provided to a refrigerant pipe 4 at the refrigerant inlet side. The opening/closing device 17*b* is provided to a pipe connecting refrigerant pipes 4 on the refrigerant inlet side and outlet side. The two second refrigerant flow switching devices 18 (second refrigerant flow switching device 18*a*, second refrigerant flow switching device 18*b*) are made up of a four-way valve or the like, switching the flow of refrigerant according to the operating mode. The second refrigerant flow switching device 18*a* is provided on the downstream side of the intermediate heat exchanger 15*a* with respect to the flow of the refrigerant during cooling operation. The second refrigerant flow switching device 18*b* is provided on the downstream side of the intermediate heat exchanger 15*a* with respect to the flow of the refrigerant during cooling only operation.

The two pumps 21 (pump 21*a*, pump 21*b*) circulate the heat medium conducted through the pipes 5. The pump 21*a* is provided on a pipe 5 between the intermediate heat exchanger 15*a* and the second heat medium flow switching devices 23. The pump 21*b* is provided on a pipe 5 between the intermediate heat exchanger 15*b* and the second heat medium flow switching devices 23. The two pumps 21 may be configured as variable-capacity pumps or the like, for example.

The four first heat medium flow switching devices 22 (first heat medium flow switching device 22*a* to first heat medium flow switching device 22*d*) are made up of a three-way valve or the like, and switch the channel of the heat medium. The number of first heat medium flow switching devices 22 provided corresponds to the number of installed indoor units 2 (herein, four). In the first heat medium flow switching devices 22, one of the three path is connected to the intermediate heat exchanger 15*a*, one of the three path is connected to the intermediate heat exchanger 15*b*, and one of the three is connected to the heat medium flow control devices 25, and are provided on the outlet side of the heat medium channels of the use side heat exchangers 26. Note that the first heat medium flow switching devices 22 are indicated as a first heat medium flow switching device 22*a*, a first heat medium flow switching device 22*b*, a first heat medium flow switching device 22*c*, and a first heat medium flow switching device 22*d* from the bottom of the page, in correspondence with the indoor units 2.

The four second heat medium flow switching devices 23 (second heat medium flow switching device 23*a* to second heat medium flow switching device 23*d*) are made up of a three-way valve or the like, and switch the channel of the heat medium. The number of second heat medium flow switching devices 23 provided corresponds to the number of installed indoor units 2 (herein, four). Of the second heat medium flow switching devices 23, one of the three paths is connected to the intermediate heat exchanger 15*a*, one of the three paths is connected to the intermediate heat exchanger 15*b*, and one of the three paths is connected to the use side heat exchangers 26, and are provided on the inlet side of the heat medium channels of the use side heat exchangers 26. Note that the second heat medium flow switching devices 23 are indicated as a second heat medium flow switching device 23*a*, a second heat medium flow switching device 23*b*, a second heat medium flow switching device 23*c*, and a second heat medium flow switching device 23*d* from the bottom of the page, in correspondence with the indoor units 2.

The four heat medium flow control devices 25 (heat medium flow control device 25*a* to heat medium flow control device 25*d*) are made up of a two-way valve or the like with a controllable opening surface area, and control the flow rate of the refrigerant flowing through the pipes 5. The number of heat medium flow control devices 25 provided corresponds to the number of installed indoor units 2 (herein, four). The heat medium flow control devices 25 are connected to the use side heat exchangers 26 on one end and to the first heat medium flow switching devices 22 on the other end, and are provided on the outlet side of the heat medium channels of the use side heat exchangers 26. Note that the heat medium flow control devices 25 are indicated as a heat medium flow control device 25*a*, a heat medium flow control device 25*b*, a heat medium flow control device 25*c*, and a heat medium flow control device 25*d* from the bottom of the page, in correspondence with the indoor units 2. Also, the heat medium flow control devices 25 may be provided on the inlet side of the heat medium channels of the use side heat exchangers 26.

The heat medium relay unit 3 is additionally provided with various detection devices (two first temperature sensors 31, four second temperature sensors 34, four third temperature sensors 35, and one pressure sensor 36). Information detected by these detection devices (temperature information, pressure information) is sent to a controller (not illustrated) that centrally controls operation of the air conditioning apparatus 100, and is used to control the driving frequency of the compressor 10, the rotation speed of the air-sending device that is not illustrated, the switching of the first refrigerant flow switching device 11, the driving frequency of the pumps 21, the switching of the second refrigerant flow switching devices 18, the switching of the channel of the heat medium, and the like.

The two first temperature sensors 31 (first temperature sensor 31*a*, first temperature sensor 31*b*) detect the temperature of the heat medium flowing out from the intermediate heat exchangers 15, or in other words, the heat medium at the outlets of the intermediate heat exchangers 15, and may be made up of thermistors or the like, for example. The first temperature sensor 31*a* is provided to the pipe 5 on the inlet side of the pump 21*a*. The first temperature sensor 31*b* is provided to the pipe 5 on the inlet side of the pump 21*b*.

The four second temperature sensors 34 (second temperature sensor 34*a* to second temperature sensor 34*d*) are provided between the first heat medium flow switching devices 22 and the heat medium flow control devices 25, detect the temperature of the heat medium flowing out from the use side heat exchangers 26, and may be made up of thermistors or the like. The number of second temperature sensors 34 provided corresponds to the number of installed indoor units 2 (herein, four). Note that the second temperature sensors 34 are indicated as a second temperature sensor 34*a*, a second temperature sensor 34*b*, a second temperature sensor 34*c*, and a second temperature sensor 34*d* from the bottom of the page, in correspondence with the indoor units 2.

The four third temperature sensors 35 (third temperature sensor 35*a* to third temperature sensor 35*d*) are provided on the refrigerant inlet side or outlet side of the intermediate heat exchangers 15, detect the temperature of refrigerant flowing into the intermediate heat exchangers 15 or the temperature of refrigerant flowing out from the intermediate heat exchangers 15, and may be made up of thermistors or the like. The third temperature sensor 35*a* is provided between the intermediate heat exchanger 15*a* and the second refrigerant flow switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow switching device 18*b*. The third temperature sensor 35*d* is provided between the intermediate heat exchanger 15*b* and the expansion device 16*b*.

The pressure sensor 36 is provided between the intermediate heat exchanger 15*b* and the expansion device 16*b*, similarly to the installation position of the third temperature sensor 35*d*, and detects the pressure of refrigerant flowing between the intermediate heat exchanger 15*b* and the expansion device 16*b*.

Additionally, a controller provided to the heat medium relay unit 3 (not illustrated) is made up of a microcontroller or the like, and on the basis of detected information from various detection devices as well as instructions from a remote control, controls the driving of the pumps 21, the opening degree of the expansion devices 16, the opening degree of the opening/closing devices 17, the switching of the second refrigerant flow switching devices 18, the switching of the first heat medium flow switching devices 22, the switching of the second heat medium flow switching devices 23, the opening degree of the heat medium flow control devices 25, and the like, and execute the respective operating modes discussed later. Note that a controller that controls the operations of both the outdoor unit 1 and the heat medium relay unit 3 may also be provided in either one of the outdoor unit 1 and the heat medium relay unit 3.

The pipes 5 that conduct the heat medium are made up of those connected to the intermediate heat exchanger 15*a*, and those connected to the intermediate heat exchanger 15*b*. The pipes 5 are branched according to the number of indoor units 2 connected to the heat medium relay unit 3 (herein, a four-way branch each). Additionally, the pipes 5 are connected by the first heat medium flow switching devices 22 and the second heat medium flow switching devices 23. By controlling the first heat medium flow switching devices 22 and the second heat medium flow switching devices 23, it is decided whether to circulate heat medium from the intermediate heat exchanger 15*a* into the use side heat exchangers 26, or circulate heat medium from the intermediate heat exchanger 15*b* into the use side heat exchangers 26.

In addition, in the air conditioning apparatus 100, the compressor 10, the first refrigerant flow switching device 11, the heat source side heat exchanger 12, the opening/closing devices 17, the second refrigerant flow switching devices 18, the refrigerant channel of the intermediate heat exchanger 15*a*, the expansion devices 16, and the accumulator 19 are connected by the refrigerant pipes 4 to constitute a refrigerant circuit A. Meanwhile, the heat medium channel of the intermediate heat exchanger 15*a*, the pumps 21, the first heat medium flow switching devices 22, the heat medium flow control devices 25, the use side heat exchangers 26, and the second heat medium flow switching devices 23 are connected by the pipes 5 to constitute a heat medium circuit B. In other words, multiple use side heat exchangers 26 are connected in parallel to each of the intermediate heat exchangers 15, making the heat medium circuit B a multi-branch circuit.

Thus, in the air conditioning apparatus 100, the outdoor unit 1 and the heat medium relay unit 3 are connected via the intermediate heat exchanger 15*a* and the intermediate heat exchanger 15*b* provided in the heat medium relay unit 3, while the heat medium relay unit 3 and the indoor units 2 are also connected via the intermediate heat exchanger 15*a* and the intermediate heat exchanger 15*b*. In other words, in the air conditioning apparatus 100, heat is exchanged between the refrigerant circulating through the refrigerant circuit A and the heat medium circulating through the heat medium circuit B by the intermediate heat exchanger 15*a* and the intermediate heat exchanger 15*b*.

Next, the respective operating modes executed by the air conditioning apparatus 100 will be described. The air conditioning apparatus 100 is capable of performing cooling operation or heating operation with each indoor unit 2, on the basis of instructions from that indoor unit 2. In other words, the air conditioning apparatus 100 is configured such that all of the indoor units 2 may operate identically, but also such that not only each of the indoor units 2 may operate differently.

The operating modes executed by the air conditioning apparatus 100 include a cooling only operating mode in which all indoor units 2 being driven execute cooling operation, a heating only operating mode in which all indoor units 2 being driven execute heating operation, a cooling main operating mode in which the cooling load is larger, and a heating main operating mode in which the heating load is larger. Hereinafter, the respective operating modes will be described together with the flows of refrigerant and heat medium.

[Cooling Only Operating Mode]

Figure 3:
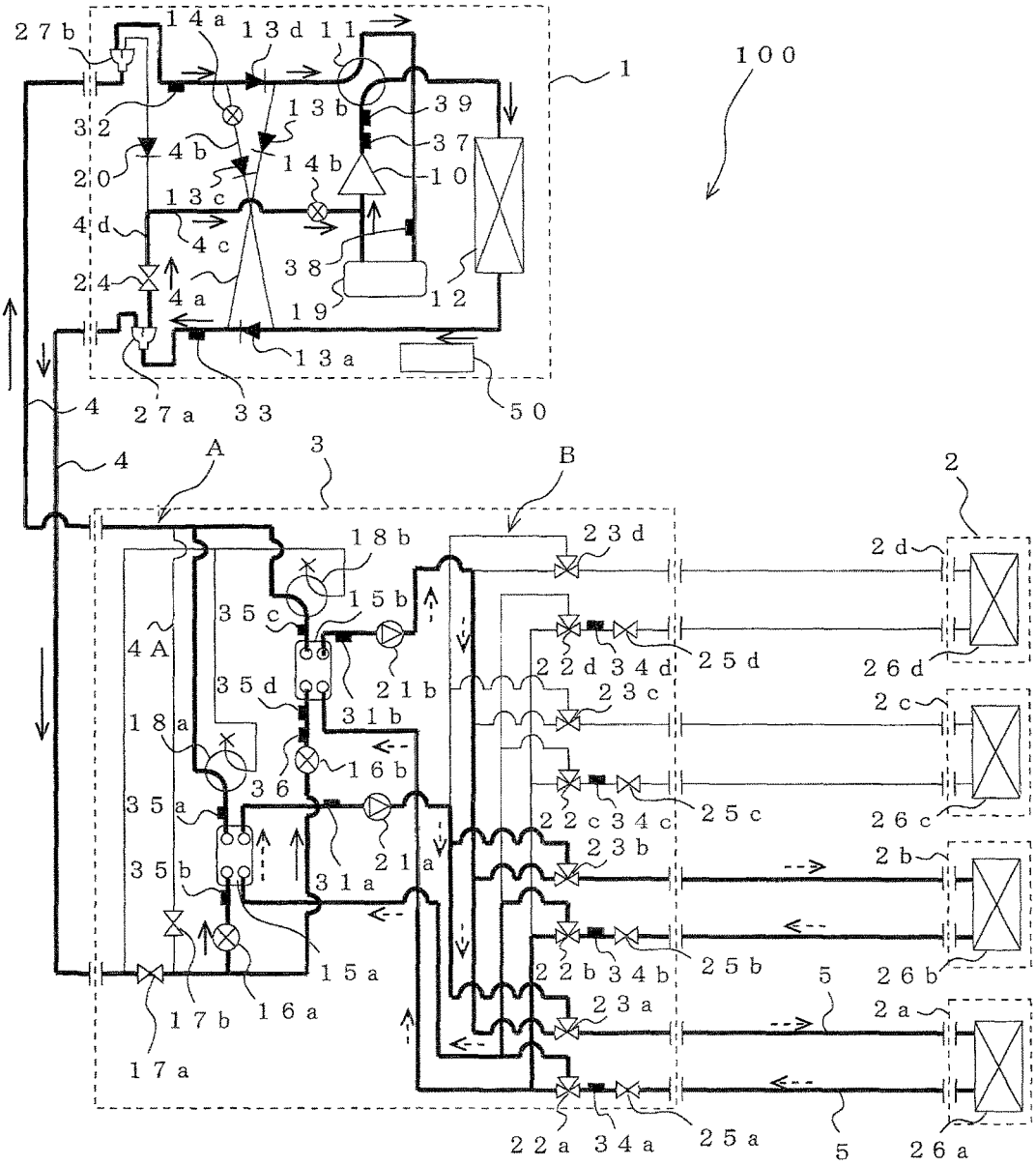
FIG. 3 is a diagram explaining the flow of refrigerant and heat medium during cooling only operation of the air conditioning apparatus illustrated in FIG. 2.

FIG. 3 is a diagram explaining the flow of refrigerant and heat medium during cooling only operation of the air conditioning apparatus 100 illustrated in FIG. 2. The cooling only operating mode will be described with FIG. 3, taking as an example the case where a cooling load is generated by only the use side heat exchanger 26*a* and the use side heat exchanger 26*b*. Note that in FIG. 3, pipes indicated in bold represent pipes carrying refrigerant (refrigerant and heat medium). Also, in FIG. 3, solid arrows indicate the direction of refrigerant flow, while broken arrows represent the direction of heat medium flow.

In the case of the cooling only operating mode illustrated in FIG. 3, in the outdoor unit 1, the first refrigerant flow switching device 11 switches such that refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed, causing heat medium to circulate between each of the intermediate heat exchanger 15*a* and the intermediate heat exchanger 15*b*, and the use side heat exchanger 26*a* and the use side heat exchanger 26*b*, respectively.

First, the flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 flows into the heat source side heat exchanger 12 via the first refrigerant flow switching device 11. Then, the refrigerant condenses and liquefies while transferring heat to the outside air in the heat source side heat exchanger 12, and becomes high pressure liquid refrigerant. The high pressure liquid refrigerant flowing out from the heat source side heat exchanger 12 passes through the check valve 13*a*, flows out from the outdoor unit 1 via the branching unit 27*a*, and passes through the refrigerant pipes 4 to flow into the heat medium relay unit 3. After passing through the opening/closing device 17*a*, the high pressure gas-liquid two-phase refrigerant flowing into the heat medium relay unit 3 is branched, and expanded by the expansion device 16*a* and the expansion device 16*b* to become a low temperature and low pressure two-phase refrigerant.

The two-phase refrigerant flows into each of the intermediate heat exchanger 15*a* and the intermediate heat exchanger 15*b* which function as evaporators, and evaporates to become low temperature and low pressure gas refrigerant while cooling the heat medium by taking away heat from the heat medium circulating through the heat medium circuit B. The gas refrigerant flowing out of the intermediate heat exchanger 15*a* and the intermediate heat exchanger 15*b* flows out from the heat medium relay unit 3 via the second refrigerant flow switching device 18*a* and the second refrigerant flow switching device 18*b*, and passes through the refrigerant pipes 4 to once again flow into the outdoor unit 1. The refrigerant flowing into the outdoor unit 1 passes through the check valve 13*d* via the branching unit 27*b*, and is once again suctioned into the compressor 10 via the first refrigerant flow switching device 11 and the accumulator 19.

At this point, the opening degree of the expansion device 16*a* is controlled such that the superheat (degree of superheat) obtained as the difference between the temperature detected by the third temperature sensor 35*a* and the temperature detected by the third temperature sensor 35*b* becomes constant. Similarly, the opening degree of the expansion device 16*b* is controlled such that the superheat (degree of superheat) obtained as the difference between the temperature detected by the third temperature sensor 35*c* and the temperature detected by the third temperature sensor 35*d* becomes constant. Also, the opening/closing device 17*a* opens, while the opening/closing device 17*b* closes.

[p-h Chart of Cooling Only Operating Mode]

Figure 4:
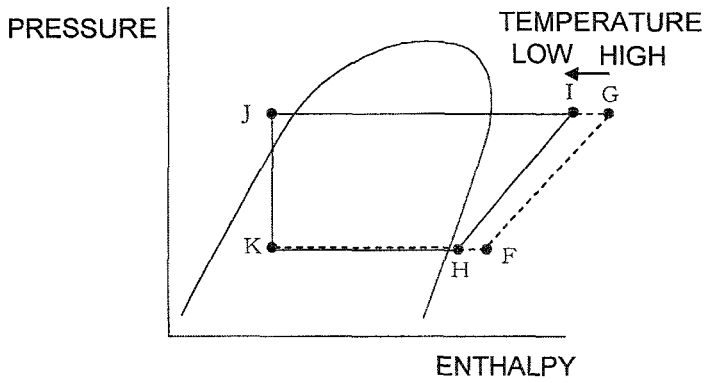
FIG. 4 is a p-h chart (pressure-enthalpy chart) during the cooling only operation illustrated in FIG. 3 and FIG. 13.

FIG. 4 is a p-h chart (pressure-enthalpy chart) during the cooling only operation illustrated in FIG. 3. Injection operations in this mode will be described using FIG. 3 and the p-h chart in FIG. 4. Refrigerant suctioned into the compressor 10 and compressed by the compressor 10 is condensed in the heat source side heat exchanger 12 to become high pressure liquid refrigerant (point J in FIG. 4). This high pressure liquid refrigerant reaches the branching unit 27*a* via the check valve 13*a*.

In the case of conducting injection, the opening/closing device 24 opens, and part of the high pressure liquid refrigerant branched at the branching unit 27*a* is made to flow into the suction injection pipe 4*c* via the opening/closing device 24 and the branch pipe 4*d*. The high pressure liquid refrigerant flowing into the suction injection pipe 4*c* is depressurized by the expansion device 14*b* to become a low temperature and low pressure gas-liquid two-phase refrigerant (point K in FIG. 4), and flows into a refrigerant pipe joining the compressor 10 and the accumulator 19.

Meanwhile, the remaining high pressure liquid refrigerant branched at the branching unit 27*a* flows into the heat medium relay unit 3, is depressurized by the expansion devices 16 to become a low pressure gas-liquid two-phase refrigerant, and additionally flows into the intermediate heat exchangers 15 which function as evaporators, becoming a low temperature and low pressure gas refrigerant. After that, the low temperature and low pressure gas refrigerant flows into the outdoor unit 1, and flows into the accumulator 19.

The low temperature and low pressure gas-liquid two-phase refrigerant flowing out from the suction injection pipe 4*c* merges with the low temperature and low pressure gas refrigerant flowing out from the accumulator 19 at a refrigerant pipe 4 connected on the suction side of the compressor 10 (point H in FIG. 4), and is suctioned into the compressor 10. The low temperature and low pressure gas-liquid two-phase refrigerant generated by this convergence is heated and evaporated by the hermetically sealed container and motor of the compressor 10, becomes a low temperature and low pressure gas refrigerant at a lower temperature than in the case of not conducting injection, is suctioned into the compression chamber of the compressor 10, and is once again discharged from the compressor 10 (point I in FIG. 4).

Note that in the case of not conducting injection, the opening/closing device 24 closes, and the high pressure liquid refrigerant branched at the branching unit 27*a* is depressurized by the expansion devices 16 to become a low pressure gas-liquid two-phase refrigerant, flows into the intermediate heat exchangers 15 which function as evaporators to become a low temperature and low pressure gas refrigerant, and is suctioned into the compressor 10 via the accumulator 19 (point F in FIG. 4). This low temperature and low pressure gas refrigerant is heated and evaporated by the hermetically sealed container and motor of the compressor 10, becomes a low temperature and low pressure gas refrigerant at a higher temperature than in the case of conducting injection, is suctioned into the compression chamber of the compressor 10, and is once again discharged from the compressor 10 (point G in FIG. 4).

In addition, the temperature of refrigerant discharged from the compressor 10 in the case of conducting injection (point I in FIG. 4) lowers with respect to the temperature of refrigerant discharged from the compressor 10 in the case of not conducting injection (point G in FIG. 4). In this way, even if the air conditioning apparatus 100 employs a refrigerant whose temperature of discharge from the compressor 10 reaches a high temperature (such as R32, for example), it is possible to lower the discharge temperature of the compressor 10, and improve the operating stability of the air conditioning apparatus 100.

Note that the refrigerant in the channel from the opening/closing device 24 in the branch pipe 4*d* to the backflow prevention device 20 is high pressure refrigerant, whereas the refrigerant which returns to the outdoor unit 1 from the heat medium relay unit 3 via the refrigerant pipes 4 and reaches the branching unit 27*b* is low pressure refrigerant. Due to the action of the backflow prevention device 20, the high pressure refrigerant in the branch pipe 4*d* is prevented from mixing with the low pressure refrigerant in the branching unit 27*b*. Since refrigerant does not flow through the expansion device 14*a*, an arbitrary opening degree may be set. The expansion device 14*b* may control the opening degree (expansion amount) such that the discharge temperature of the compressor 10 detected by the discharge refrigerant temperature detection device 37 does not become too high.

Next, the flow of heat medium in the heat medium circuit B will be described.

In the cooling only operating mode, the cooling energy of the refrigerant is transferred to the heat medium in both the intermediate heat exchanger 15*a* and the intermediate heat exchanger 15*b*, and the cooled heat medium is made to flow inside the pipes 5 by the pump 21*a* and the pump 21*b*. Outflowing heat medium pressurized by the pump 21*a* and the pump 21*b* flows into the use side heat exchanger 26*a* and the use side heat exchanger 26*b* via the second heat medium flow switching device 23*a* and the second heat medium flow switching device 23*b*. Then, the heat medium takes away heat from the indoor air at the use side heat exchanger 26*a* and the use side heat exchanger 26*b*, thereby cooling the indoor space 7.

Subsequently, the heat medium flows out from the use side heat exchanger 26*a* and the use side heat exchanger 26*b*, and flows into the heat medium flow control device 25*a* and the heat medium flow control device 25*b*. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium flowing out from the heat medium flow control device 25*a* and the heat medium flow control device 25*b* passes through the first heat medium flow switching device 22*a* and the first heat medium flow switching device 22*b*, flows into the intermediate heat exchanger 15*a* and the intermediate heat exchanger 15*b*, and is once again suctioned into the pump 21*a* and the pump 21*b*.

Note that inside the pipes 5 of the use side heat exchangers 26, the heat medium flows in the direction going from the second heat medium flow switching devices 23 to the first heat medium flow switching devices 22 via the heat medium flow control devices 25. In addition, the air conditioning load required in the indoor space 7 may be covered by applying control to keep the difference between the temperature detected by the first temperature sensor 31*a* or the temperature detected by the first temperature sensor 31*b* versus the temperature detected by the second temperature sensors 34 at a target value. The temperature of either the first temperature sensor 31*a* or the first temperature sensor 31*b* may be used as the outlet temperature of the intermediate heat exchangers 15, or their average temperature may be used. At this point, the first heat medium flow switching devices 22 and the second heat medium flow switching devices 23 are set to intermediate opening degrees to maintain channels flowing into both the intermediate heat exchanger 15*a* and the intermediate heat exchanger 15*b*.

Figure 7:
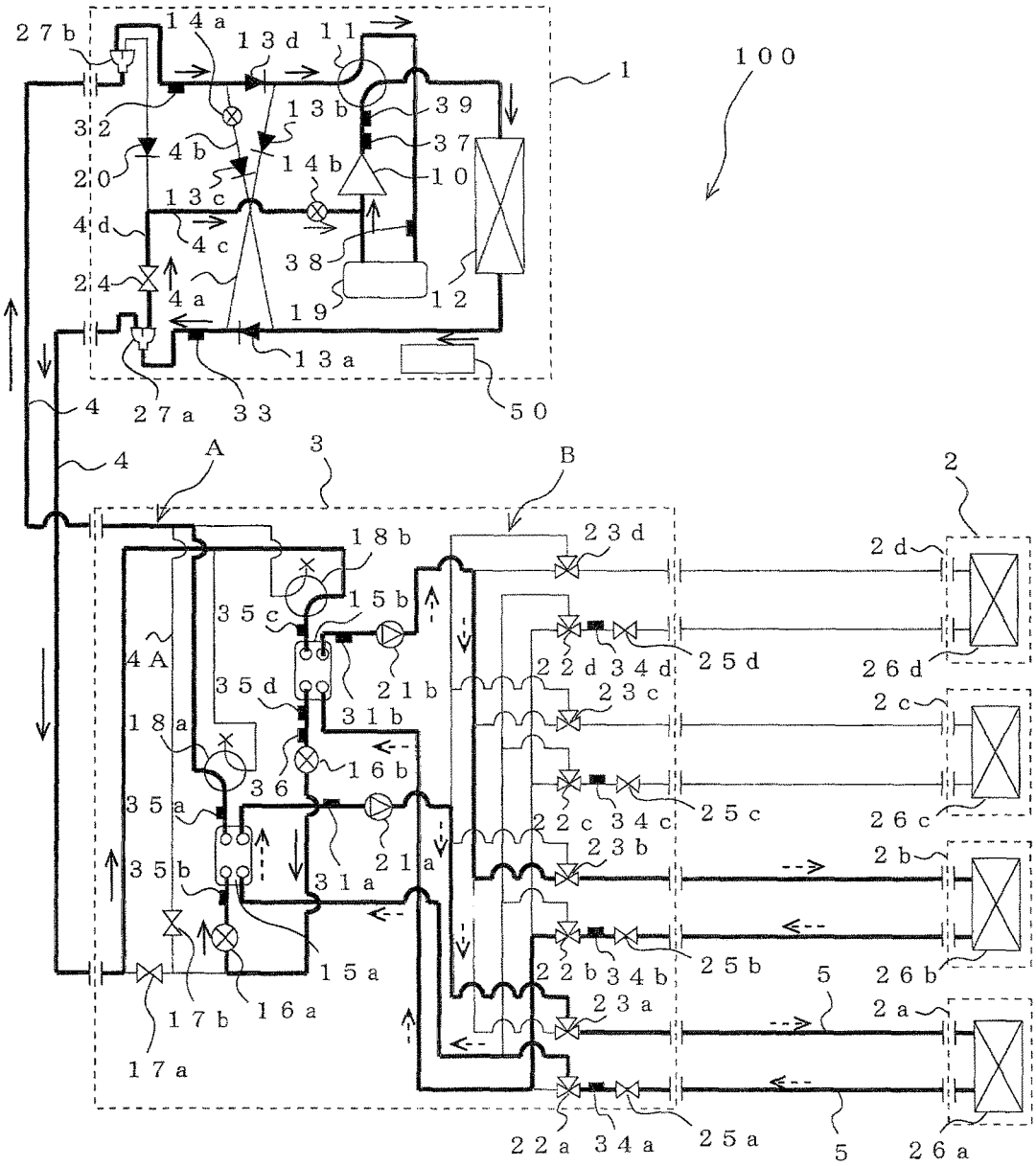
FIG. 7 is a diagram explaining the flow of refrigerant and heat medium during cooling main operation of the air conditioning apparatus illustrated in FIG. 2.

When executing the cooling only operating mode, it is not necessary for the heat medium to flow to use side heat exchangers 26 with no heat load (including those switched off by thermostat control). For this reason, the heat medium is made to not flow to the use side heat exchangers 26 by closing channels with the heat medium flow control devices 25. In FIG. 7, heat medium is flowing through the use side heat exchanger 26*a* and the use side heat exchanger 26*b* because a heat load exists, but since there is no heat load on the use side heat exchanger 26*c* and the use side heat exchanger 26*d*, the heat medium flow control device 25*c* and the heat medium flow control device 25*d* are fully closed. Furthermore, in the case where a heat load is generated from the use side heat exchanger 26*c* or the use side heat exchanger 26*d*, the heat medium flow control device 25*c* or the heat medium flow control device 25*d* may be opened to allow the circulation of heat medium.

[Heating Only Operating Mode]

Figure 5:
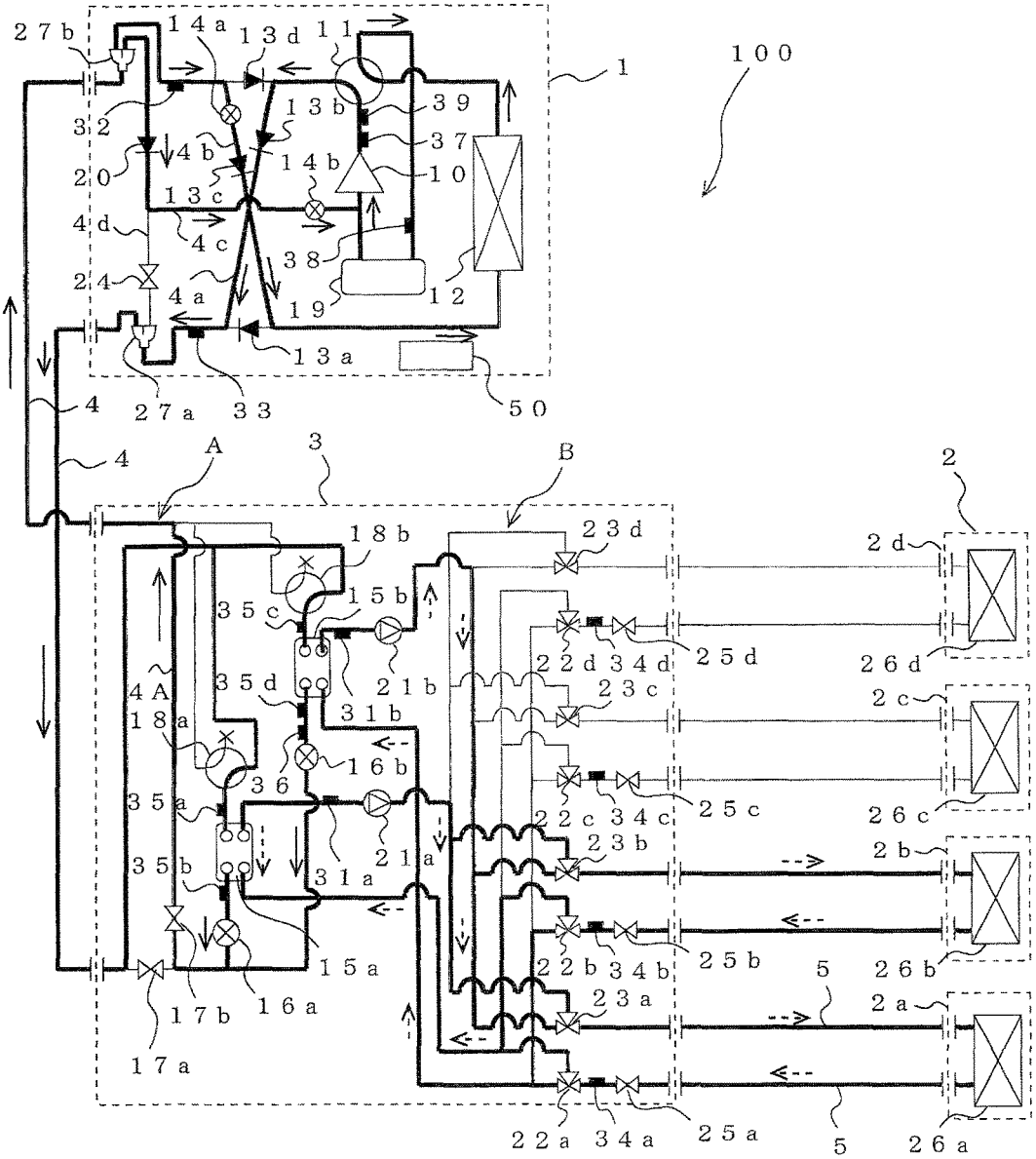
FIG. 5 is a diagram explaining the flow of refrigerant and heat medium during heating only operation of the air conditioning apparatus illustrated in FIG. 2.

FIG. 5 is a diagram explaining the flow of refrigerant and heat medium during heating only operation of the air conditioning apparatus 100 illustrated in FIG. 2. The heating only operating mode will be described with FIG. 5, taking as an example the case where a heating load is generated by only the use side heat exchanger 26*a* and the use side heat exchanger 26*b*. Note that in FIG. 5, pipes indicated in bold represent pipes carrying refrigerant (refrigerant and heat medium). Also, in FIG. 5, solid arrows indicate the direction of refrigerant flow, while broken arrows represent the direction of heat medium flow.

In the case of the heating only operating mode illustrated in FIG. 5, in the outdoor unit 1, the first refrigerant flow switching device 11 switches such that refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed, causing heat medium to circulate between each of the intermediate heat exchanger 15*a* and the intermediate heat exchanger 15*b*, and each of the use side heat exchanger 26*a* and the use side heat exchanger 26*b*, respectively.

First, the flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 goes through the first refrigerant flow switching device 11, is conducted through the first connecting pipe 4*a*, passes through the check valve 13*b* and the branching unit 27*a*, and flows out from the outdoor unit 1. The high temperature and high pressure gas refrigerant flowing out of the outdoor unit 1 flows into the heat medium relay unit 3 via the refrigerant pipes 4. The high temperature and high pressure gas refrigerant flowing into the heat medium relay unit 3 is branched, goes through the second refrigerant flow switching device 18*a* and the second refrigerant flow switching device 18*b*, and respectively flows into the intermediate heat exchanger 15*a* and the intermediate heat exchanger 15*b*.

The high temperature and high pressure gas refrigerant flowing into the intermediate heat exchanger 15*a* and the intermediate heat exchanger 15*b* condenses and liquefies to become high pressure liquid refrigerant while transferring heat to the heat medium circulating through the heat medium circuit B. The liquid refrigerant flowing out of the intermediate heat exchanger 15*a* and the intermediate heat exchanger 15*b* is expanded by the expansion device 16*a* and the expansion device 16*b* to become a medium temperature and medium pressure two-phase refrigerant. This two-phase refrigerant goes through the opening/closing device 17*b*, flows out from the heat medium relay unit 3, goes through the refrigerant pipes 4, and once again flows into the outdoor unit 1. The refrigerant flowing into the outdoor unit 1 flows into the second connecting pipe 4*b* via the branching unit 27*b*, goes through the expansion device 14*a*, is constricted by the expansion device 14*a* to become low temperature and low pressure two-phase refrigerant, passes through the check valve 13*c*, and flows into the heat source side heat exchanger 12 which functions as an evaporator.

Then, the refrigerant flowing into the heat source side heat exchanger 12 takes away heat from the outside air at the heat source side heat exchanger 12, and becomes a low temperature and low pressure gas refrigerant. The low temperature and low pressure gas refrigerant flowing out of the heat source side heat exchanger 12 is once again suctioned into the compressor 10 via the first refrigerant flow switching device 11 and the accumulator 19.

At this point, the opening degree of the expansion device 16*a* is controlled such that the subcooling (degree of cooling) obtained as the difference between the temperature detected by the third temperature sensor 35*b* and a value obtained by converting the pressure detected by the pressure sensor 36 into a saturation temperature becomes constant. Similarly, the opening degree of the expansion device 16*b* is controlled such that the subcooling obtained as the difference between the temperature detected by the third temperature sensor 35*d* and a value obtained by converting the pressure detected by the pressure sensor 36 into a saturation temperature becomes constant. Also, the opening/closing device 17*a* closes, while the opening/closing device 17*b* opens. Note that in the case where the temperature at an intermediate position between the intermediate heat exchangers 15 can be measured, the temperature at that intermediate position may be used instead of the pressure sensor 36, making it possible to configure the system at lower cost.

[Heating Only Operating Mode p-h Chart]

Figure 6:
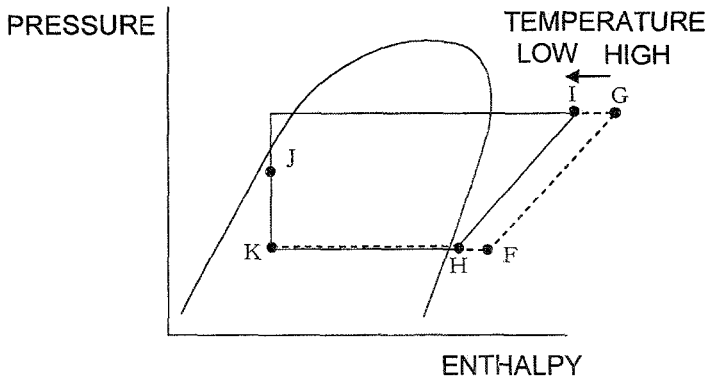
FIG. 6 is a p-h chart during the heating only operation illustrated in FIG. 5 and FIG. 14.

FIG. 6 is a p-h chart during the heating only operation illustrated in FIG. 5. Injection operations in this mode will be described using FIG. 5 and the p-h chart in FIG. 6. Refrigerant suctioned into the compressor 10 and compressed by the compressor 10 flows out of the outdoor unit 1 and is condensed by the intermediate heat exchangers 15 of the heat medium relay unit 3 to reach medium temperature, is depressurized by the expansion devices 16 to reach medium pressure (point J in FIG. 6), and flows from the heat medium relay unit 3 into the outdoor unit 1 via the refrigerant pipes 4. The medium temperature and medium pressure two-phase refrigerant flowing into the outdoor unit 1 reaches the branching unit 27*b*.

In the case of conducting injection, the expansion device 14*b* is opened to a designated opening degree, and part of the medium temperature and medium pressure refrigerant branched at the branching unit 27*b* is made to flow into the suction injection pipe 4*c* via the branch pipe 4*d*. The medium temperature and medium pressure refrigerant flowing into the suction injection pipe 4*c* is depressurized by the expansion device 14*b* to become a low temperature and low pressure gas-liquid two-phase refrigerant (point K in FIG. 6), and flows into a refrigerant pipe joining the compressor 10 and the accumulator 19.

Meanwhile, the remaining medium temperature and medium pressure refrigerant branched at the branching unit 27*b* is depressurized by the expansion device 14*a* to become a low pressure gas-liquid two-phase refrigerant, and additionally flows into the heat source side heat exchanger 12 which functions as an evaporator, becoming a low temperature and low pressure gas-liquid two-phase refrigerant. After that, the low temperature and low pressure gas-liquid two-phase refrigerant flows into the accumulator 19.

The low temperature and low pressure gas-liquid two-phase refrigerant flowing out from the suction injection pipe 4*c* merges with the low temperature and low pressure gas-liquid two-phase refrigerant flowing out from the accumulator 19 at a refrigerant pipe 4 connected on the suction side of the compressor 10 (point H in FIG. 6), and is suctioned into the compressor 10. The low temperature and low pressure gas-liquid two-phase refrigerant is heated and evaporated by the hermetically sealed container and motor of the compressor 10, becomes a low temperature and low pressure gas refrigerant at a lower temperature than in the case of not conducting injection, is suctioned into the compression chamber of the compressor 10, and is once again discharged from the compressor 10 (point I in FIG. 4).

Note that in the case of not conducting injection, the expansion device 14*b* closes, and the medium temperature and medium pressure gas-liquid two-phase refrigerant that passed through the branching unit 27*b* is depressurized by the expansion device 14*a* to become a low pressure gas-liquid two-phase refrigerant, flows into the heat source side heat exchanger 12, which functions as an evaporator, to become a low temperature and low pressure gas-liquid two-phase refrigerant, and is suctioned into the compressor 10 via the accumulator 19 (point F in FIG. 6). This low temperature and low pressure gas-liquid two-phase refrigerant is heated and evaporated by the hermetically sealed container and motor of the compressor 10, becomes a low temperature and low pressure gas refrigerant at a higher temperature than in the case of conducting injection, is suctioned into the compression chamber of the compressor 10, and is once again discharged from the compressor 10 (point G in FIG. 6).

In addition, the temperature of refrigerant discharged from the compressor 10 in the case of conducting injection (point I in FIG. 6) lowers with respect to the temperature of refrigerant discharged from the compressor 10 in the case of not conducting injection (point G in FIG. 6). In this way, even if the air conditioning apparatus 100 employs a refrigerant whose temperature of discharge from the compressor 10 reaches a high temperature (such as R32, for example), it is possible to lower the discharge temperature of the compressor 10, and improve the operating stability of the air conditioning apparatus 100.

Note that the opening/closing device 24 closes, preventing the refrigerant in a high pressure state from the branching unit 27*a* from mixing with the refrigerant in a medium pressure state coming via the backflow prevention device 20. Also, if the expansion device 14*a* applies control such that the medium pressure detected by the medium pressure detection device 32 becomes a constant value, control of the temperature of discharge from the expansion device 14*b* stabilizes. Furthermore, the opening degree (expansion amount) of the expansion device 14*b* is controlled such that the discharge temperature of the compressor 10 detected by the discharge refrigerant temperature detection device 37 does not become too high.

Also, in the heating only operating mode, since the intermediate heat exchanger 15*a* and the intermediate heat exchanger 15*b* are both heating the heat medium, control may also be applied to raise the pressure (medium pressure) of the refrigerant on the upstream side of the expansion device 14*a* insofar as the pressure is within a range enabling the expansion device 16*a* and the expansion device 16*b* to control subcooling. If control is applied to raise the medium pressure, the differential pressure between the inside of the compression chamber and the pressure can be increased, and thus the quantity of refrigerant to inject on the suction side of the compression chamber can be increased, and it is possible to supply the compressor 10 with an injection flow sufficient to lower the discharge temperature, even in cases where the outside air temperature is low.

Next, the flow of heat medium in the heat medium circuit B will be described. In the heating only operating mode, the heating energy of the refrigerant is transferred to the heat medium in both the intermediate heat exchanger 15*a* and the intermediate heat exchanger 15*b*, and the heated heat medium is made to flow inside the pipes 5 by the pump 21*a* and the pump 21*b*. Outflowing heat medium pressurized by the pump 21*a* and the pump 21*b* flows into the use side heat exchanger 26*a* and the use side heat exchanger 26*b* via the second heat medium flow switching device 23*a* and the second heat medium flow switching device 23*b*. Then, the heat medium transfers heat to the indoor air at the use side heat exchanger 26*a* and the use side heat exchanger 26*b*, thereby heating the indoor space 7.

Subsequently, the heat medium flows out from the use side heat exchanger 26*a* and the use side heat exchanger 26*b*, and flows into the heat medium flow control device 25*a* and the heat medium flow control device 25*b*. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium flowing out from the heat medium flow control device 25*a* and the heat medium flow control device 25*b* passes through the first heat medium flow switching device 22*a* and the first heat medium flow switching device 22*b*, flows into the intermediate heat exchanger 15*a* and the intermediate heat exchanger 15*b*, and is once again suctioned into the pump 21*a* and the pump 21*b*.

Note that inside the pipes 5 of the use side heat exchangers 26, the heat medium flows in the direction going from the second heat medium flow switching devices 23 to the first heat medium flow switching devices 22 via the heat medium flow control devices 25. In addition, the air conditioning load required in the indoor space 7 may be covered by applying control to keep the difference between the temperature detected by the first temperature sensor 31*a* or the temperature detected by the first temperature sensor 31*b* versus the temperature detected by the second temperature sensors 34 at a target value. The temperature of either the first temperature sensor 31*a* or the first temperature sensor 31*b* may be used as the outlet temperature of the intermediate heat exchangers 15, or their average temperature may be used.

At this point, the first heat medium flow switching devices 22 and the second heat medium flow switching devices 23 are set to intermediate opening degrees to maintain channels flowing into both the intermediate heat exchanger 15*a* and the intermediate heat exchanger 15*b*. Also, although the use side heat exchanger 26*a* should ideally be controlled according to the inlet versus outlet temperature difference, the heat medium temperature on the inlet side of the use side heat exchangers 26 is nearly the same temperature as the temperature detected by the first temperature sensor 31*b*, and thus using the first temperature sensor 31*b* enables a reduction in the number of temperature sensors, making it possible to configure the system at lower cost.

When executing the heating only operating mode, it is not necessary for the heat medium to flow to use side heat exchangers 26 with no heat load (including those switched off by thermostat control). For this reason, the heat medium is made to not flow to the use side heat exchangers 26 by closing channels with the heat medium flow control devices 25. In FIG. 5, heat medium is flowing through the use side heat exchanger 26*a* and the use side heat exchanger 26*b* because a heat load exists, but since there is no heat load on the use side heat exchanger 26*c* and the use side heat exchanger 26*d*, the heat medium flow control device 25*c* and the heat medium flow control device 25*d* corresponding thereto are fully closed. Furthermore, in the case where a heat load is generated from the use side heat exchanger 26*c* or the use side heat exchanger 26*d*, the heat medium flow control device 25*c* or the heat medium flow control device 25*d* may be opened to allow the circulation of heat medium.

[Cooling Main Operating Mode]

FIG. 7 is a diagram explaining the flow of refrigerant and heat medium during cooling main operation of the air conditioning apparatus 100 illustrated in FIG. 2. The cooling main operating mode will be described with FIG. 7, taking as an example the case where a cooling load is generated by the use side heat exchanger 26*a*, and a heating load is generated by the use side heat exchanger 26*b*. Note that in FIG. 7, pipes indicated in bold represent pipes circulating refrigerant (refrigerant and heat medium). Also, in FIG. 7, solid arrows indicate the direction of refrigerant flow, while broken arrows represent the direction of heat medium flow.

In the case of the cooling main operating mode illustrated in FIG. 7, in the outdoor unit 1, the first refrigerant flow switching device 11 switches such that refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* open, and the heat medium flow control device 25*c* and the heat medium flow control device 25*d* fully close, causing heat medium to respectively circulate between the intermediate heat exchanger 15*a* and the use side heat exchanger 26*a*, and between the intermediate heat exchanger 15*b* and the use side heat exchanger 26*b*.

First, the flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 flows into the heat source side heat exchanger 12 via the first refrigerant flow switching device 11. The refrigerant then condenses to become two-phase refrigerant while transferring heat to the outside air in the heat source side heat exchanger 12. The two-phase refrigerant flowing out from the heat source side heat exchanger 12 passes through the check valve 13*a*, flows out from the outdoor unit 1 via the branching unit 27*a*, and goes through the refrigerant pipes 4 to flow into the heat medium relay unit 3. The two-phase refrigerant flowing into the heat medium relay unit 3 goes through the second refrigerant flow switching device 18*b*, and flows into the intermediate heat exchanger 15*b* which acts as a condenser.

The two-phase refrigerant flowing into the intermediate heat exchanger 15*b* condenses and liquefies to become liquid refrigerant while transferring heat to the heat medium circulating through the heat medium circuit B. The liquid refrigerant flowing out of the intermediate heat exchanger 15*b* is expanded by the expansion device 16*b* to become low pressure two-phase refrigerant. This low pressure two-phase refrigerant flows via the expansion device 16*a* into the intermediate heat exchanger 15*a*, which acts as an evaporator. The low pressure two-phase refrigerant flowing into the intermediate heat exchanger 15*a* takes away heat from the heat medium circulating through the heat medium circuit B, thus becoming low pressure gas refrigerant while cooling the heat medium. This gas refrigerant flows out of the intermediate heat exchanger 15*a*, flows out of the heat medium relay unit 3 via the second refrigerant flow switching device 18*a*, and once again flows into the outdoor unit 1 via the refrigerant pipes 4. The refrigerant flowing into the outdoor unit 1 passes through the check valve 13*d* via the branching unit 27*b*, and is once again suctioned into the compressor 10 via the first refrigerant flow switching device 11 and the accumulator 19.

At this point, the opening degree of the expansion device 16*b* is controlled such that the superheat obtained as the difference between the temperature detected by the third temperature sensor 35*a* and the temperature detected by the third temperature sensor 35*b* becomes constant. Also, the expansion device 16*a* fully opens, while the opening/closing devices 17*a* and 17*b* close. Note that the opening degree of the expansion device 16*b* may also be controlled such that the subcooling obtained as the difference between the temperature detected by the third temperature sensor 35*d* and a value obtained by converting the pressure detected by the pressure sensor 36 into a saturation temperature becomes constant. Also, the expansion device 16*b* may fully open, and the superheat or subcooling may be controlled with the expansion device 16*a*.

[Cooling Main Operating Mode p-h Chart]

Figure 8:
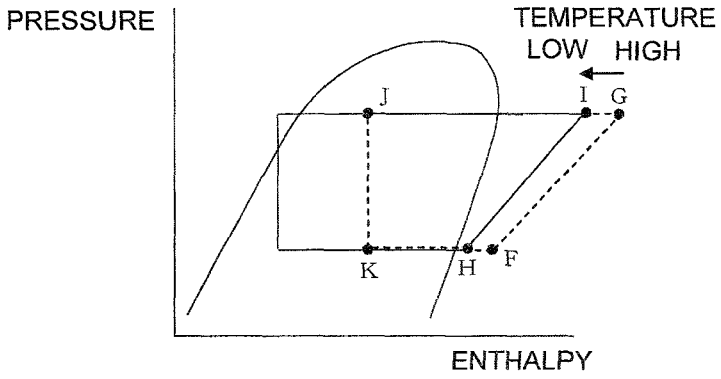
FIG. 8 is a p-h chart during the cooling main operation illustrated in FIG. 7 and FIG. 15.

FIG. 8 is a p-h chart during the cooling main operation illustrated in FIG. 7. Injection operations in this mode will be described using FIG. 7 and the p-h chart in FIG. 8.

Refrigerant suctioned into the compressor 10 and compressed by the compressor 10 is condensed in the heat source side heat exchanger 12 to become high pressure gas-liquid two-phase refrigerant (point J in FIG. 8). This high pressure gas-liquid two-phase refrigerant reaches the branching unit 27*a* via the check valve 13*a*.

In the case of conducting injection, the opening/closing device 24 opens, and part of the high pressure gas-liquid two-phase refrigerant branched at the branching unit 27*a* is made to flow into the suction injection pipe 4*c* via the opening/closing device 24 and the branch pipe 4*d*. The high pressure gas-liquid two-phase refrigerant flowing into the suction injection pipe 4*c* is depressurized by the expansion device 14*b* to become a low temperature and low pressure gas-liquid two-phase refrigerant (point K in FIG. 8), and flows into a refrigerant pipe joining the compressor 10 and the accumulator 19. Meanwhile, the remaining high pressure gas-liquid two-phase refrigerant branched at the branching unit 27*a* flows into the heat medium relay unit 3, is depressurized by the expansion devices 16 to become a low pressure gas-liquid two-phase refrigerant, and additionally flows into the intermediate heat exchangers 15 which act as evaporators, becoming a low temperature and low pressure gas refrigerant. After that, the low temperature and low pressure gas refrigerant returns to the outdoor unit 1, and flows into the accumulator 19.

The low temperature and low pressure gas-liquid two-phase refrigerant flowing out from the suction injection pipe 4*c* merges with the low temperature and low pressure gas refrigerant flowing out from the accumulator 19 at a refrigerant pipe 4 connected on the suction side of the compressor 10 (point H in FIG. 8), and is suctioned into the compressor 10. The low temperature and low pressure gas-liquid two-phase refrigerant generated by this convergence is heated and evaporated by the hermetically sealed container and motor of the compressor 10, becomes a low temperature and low pressure gas refrigerant at a lower temperature than in the case of not conducting injection, is suctioned into the compression chamber of the compressor 10, and is once again discharged from the compressor 10 (point I in FIG. 8).

Note that in the case of not conducting injection, the opening/closing device 24 closes, and the high pressure gas-liquid two-phase refrigerant branched at the branching unit 27*a* flows into the expansion device 16*b* and the expansion device 16*a* via the intermediate heat exchanger 15*b* which functions as a condenser, becoming a low pressure gas-liquid two-phase refrigerant, and flows into the intermediate heat exchanger 15*a* which functions as an evaporator, becoming a low temperature and low pressure gas-liquid two-phase refrigerant. After that, the low temperature and low pressure gas-liquid two-phase refrigerant is suctioned into the compressor 10 via the accumulator 19 (point F in FIG. 8). This low temperature and low pressure gas-liquid two-phase refrigerant is heated and evaporated by the hermetically sealed container and motor of the compressor 10, becomes a low temperature and low pressure gas refrigerant at a higher temperature than in the case of conducting injection, is suctioned into the compression chamber of the compressor 10, and is once again discharged from the compressor 10 (point G in FIG. 8).

In addition, the temperature of refrigerant discharged from the compressor 10 in the case of conducting injection (point I in FIG. 8) lowers with respect to the temperature of refrigerant discharged from the compressor 10 in the case of not conducting injection (point G in FIG. 8). In this way, even if the air conditioning apparatus 100 implements a refrigerant whose temperature of discharge from the compressor 10 reaches a high temperature (such as R32, for example), it is possible to lower the discharge temperature of the compressor 10, and improve the operating stability of the air conditioning apparatus 100.

Note that the refrigerant in the channel from the opening/closing device 24 in the branch pipe 4*d* to the backflow prevention device 20 is high pressure refrigerant, whereas the refrigerant which returns to the outdoor unit 1 from the heat medium relay unit 3 via the refrigerant pipes 4 and reaches the branching unit 27*b* is low pressure refrigerant. Due to the action of the backflow prevention device 20, the high pressure refrigerant in the branch pipe 4*d* is prevented from mixing with the low pressure refrigerant in the branching unit 27*b*. Since refrigerant does not flow through the expansion device 14*a*, an arbitrary opening degree may be set. The expansion device 14*b* may control the opening degree (expansion amount) such that the discharge temperature of the compressor 10 detected by the discharge refrigerant temperature detection device 37 does not become too high.

Next, the flow of heat medium in the heat medium circuit B will be described.

In the cooling main operating mode, the heating energy of the refrigerant is transferred to the heat medium in the intermediate heat exchanger 15*b*, and the heated heat medium is made to flow inside the pipes 5 by the pump 21*b*. Also, in the cooling main operating mode, the cooling energy of the refrigerant is transferred to the heat medium in the intermediate heat exchanger 15*a*, and the cooled heat medium is made to flow inside the pipes 5 by the pump 21*a*. Outflowing heat medium pressurized by the pump 21*a* and the pump 21*b* flows into the use side heat exchanger 26*a* and the use side heat exchanger 26*b* via the second heat medium flow switching device 23*a* and the second heat medium flow switching device 23*b*.

In the use side heat exchanger 26*b*, the heat medium transfers heat to the indoor air, thereby heating the indoor space 7. Also, in the use side heat exchanger 26*a*, the heat medium takes away heat from the indoor air, thereby cooling the indoor space 7. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium with slightly lowered temperature having passed through the use side heat exchanger 26*b* goes through the heat medium flow control device 25*b* and the first heat medium flow switching device 22*b*, flows into the intermediate heat exchanger 15*b*, and is once again suctioned into the pump 21*b*. The heat medium with slightly raised temperature passing through the use side heat exchanger 26*a* goes through the heat medium flow control device 25*a* and the first heat medium flow switching device 22*a*, flows into the intermediate heat exchanger 15*a*, and is once again suctioned into the pump 21*a*.

Meanwhile, the warm heat medium and the cool heat medium is introduced into use side heat exchangers 26 having a heating load and a cooling load, respectively, and due to the action of the first heat medium flow switching devices 22 and the second heat medium flow switching devices 23, the heat medium does not mix. Note that inside the pipes 5 of the use side heat exchangers 26, on both the heating side and the cooling side, the heat medium flows in the direction going from the second heat medium flow switching devices 23 to the first heat medium flow switching devices 22 via the heat medium flow control devices 25. In addition, the air conditioning load required in the indoor space 7 may be covered by control to keep the difference between the temperature detected by the first temperature sensor 31*b* versus the temperature detected by the second temperature sensors 34 at a target value on the heating side, while keeping the difference between the temperature detected by the second temperature sensors 34 versus the temperature detected by the first temperature sensor 31*a* at a target value on the cooling side.

When executing the cooling main operating mode, it is not necessary for the heat medium to flow to use side heat exchangers 26 with no heat load (including those switched off by thermostat control). For this reason, the heat medium is made to not flow to the use side heat exchangers 26 by closing channels with the heat medium flow control devices 25. In FIG. 7, heat medium is flowing through the use side heat exchanger 26*a* and the use side heat exchanger 26*b* because a heat load exists, but since there is no heat load on the use side heat exchanger 26*c* and the use side heat exchanger 26*d*, the heat medium flow control device 25*c* and the heat medium flow control device 25*d* are fully closed. Furthermore, in the case where a heat load is generated from the use side heat exchanger 26*c* or the use side heat exchanger 26*d*, the heat medium flow control device 25*c* or the heat medium flow control device 25*d* may be opened to allow the circulation of heat medium.

[Heating Main Operating Mode]

Figure 9:
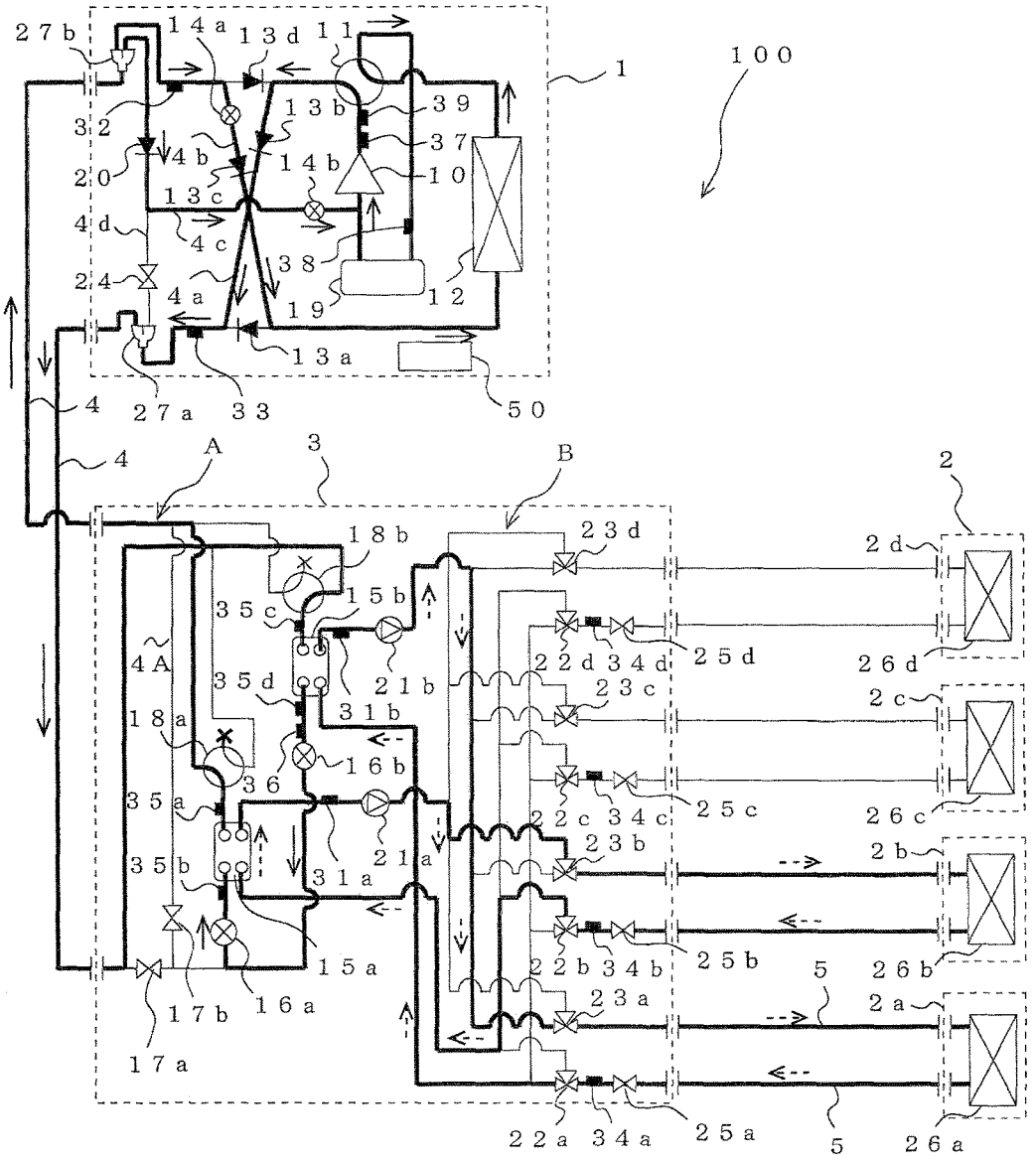
FIG. 9 is a diagram explaining the flow of refrigerant and heat medium during heating only operation of the air conditioning apparatus illustrated in FIG. 2.

FIG. 9 is a diagram explaining the flow of refrigerant and heat medium during heating only operation of the air conditioning apparatus 100 illustrated in FIG. 2. The heating main operating mode will be described with FIG. 9, taking as an example the case where a heating load is generated by the use side heat exchanger 26*a*, and a cooling load is generated by the use side heat exchanger 26*b*. Note that in FIG. 9, pipes indicated in bold represent pipes circulating refrigerant (refrigerant and heat medium). Also, in FIG. 9, solid arrows indicate the direction of refrigerant flow, while broken arrows represent the direction of heat medium flow.

In the case of the heating main operating mode illustrated in FIG. 9, in the outdoor unit 1, the first refrigerant flow switching device 11 switches such that refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are fully opened, and the heat medium flow control device 25*c* and the heat medium flow control device 25*d* are fully closed, causing heat medium to circulate between each of the intermediate heat exchanger 15*a* and the intermediate heat exchanger 15*b*, and the use side heat exchanger 26*a* and the use side heat exchanger 26*b*, respectively.

First, the flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 goes through the first refrigerant flow switching device 11, is conducted through the first connecting pipe 4*a*, passes through the check valve 13*b*, and flows out from the outdoor unit 1 via the branching unit 27*a*. The high temperature and high pressure gas refrigerant flowing out of the outdoor unit 1 flows into the heat medium relay unit 3 via the refrigerant pipes 4. The high temperature and high pressure gas refrigerant flowing into the heat medium relay unit 3 goes through the second refrigerant flow switching device 18*b*, and flows into the intermediate heat exchanger 15*b* which acts as a condenser.

The gas refrigerant flowing into the intermediate heat exchanger 15*b* condenses and liquefies to become gas-liquid two-phase refrigerant while transferring heat to the heat medium circulating through the heat medium circuit B. The gas-liquid two-phase refrigerant flowing out of the intermediate heat exchanger 15*b* is expanded by the expansion device 16*b* to become medium pressure two-phase refrigerant. This medium pressure two-phase refrigerant flows via the expansion device 16*a* into the intermediate heat exchanger 15*a*, which acts as an evaporator. The medium pressure two-phase refrigerant flowing into the intermediate heat exchanger 15*a* evaporates by taking away heat from the heat medium circulating through the heat medium circuit B, thus cooling the heat medium. This low pressure two-phase refrigerant flows out of the intermediate heat exchanger 15*a*, flows out of the heat medium relay unit 3 via the second refrigerant flow switching device 18*a*, and once again flows into the outdoor unit 1 via the refrigerant pipes 4.

The refrigerant flowing into the outdoor unit 1 flows into the second connecting pipe 4*b* via the branching unit 27*b*, goes through the expansion device 14*a*, is constricted by the expansion device 14*a* to become low temperature and low pressure two-phase refrigerant, goes through the check valve 13*c*, and flows into the heat source side heat exchanger 12 which acts as an evaporator. Then, the refrigerant flowing into the heat source side heat exchanger 12 takes away heat from the outside air at the heat source side heat exchanger 12, and becomes a low temperature and low pressure gas refrigerant. The low temperature and low pressure gas refrigerant flowing out of the heat source side heat exchanger 12 is once again suctioned into the compressor 10 via the first refrigerant flow switching device 11 and the accumulator 19.

At this point, the opening degree of the expansion device 16*b* is controlled such that the subcooling obtained as the difference between the temperature detected by the third temperature sensor 35*b* and a value obtained by converting the pressure detected by the pressure sensor 36 into a saturation temperature becomes constant. Also, the expansion device 16*a* fully opens, while the opening/closing device 17*a* closes, and the opening/closing device 17*b* closes. Note that the expansion device 16*b* may fully open, and the subcooling may be controlled with the expansion device 16*a*.

[Heating Main Operating Mode p-h Chart]

Figure 10:
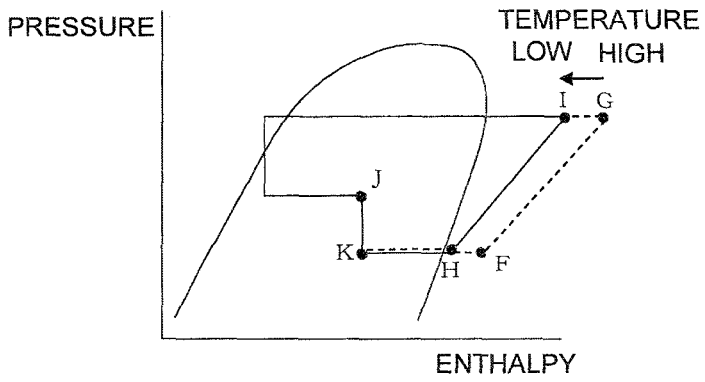
FIG. 10 is a p-h chart during the heating main operation illustrated in FIG. 9 and FIG. 16.

FIG. 10 is a p-h chart during the heating main operation illustrated in FIG. 9. Injection operations in this mode will be described using FIG. 9 and the p-h chart in FIG. 10.

Refrigerant suctioned into the compressor 10 and compressed by the compressor 10 flows out of the outdoor unit 1 and is condensed by the intermediate heat exchanger 15*a* of the heat medium relay unit 3, is depressurized by the expansion device 16*a* and the expansion device 16*b* to reach medium pressure, and is evaporated by the intermediate heat exchanger 15*b* to reach medium temperature (point J in FIG. 10), and flows from the heat medium relay unit 3 into the outdoor unit 1 via the refrigerant pipes 4. The medium temperature and medium pressure refrigerant flowing into the outdoor unit 1 reaches the branching unit 27*b*.

In the case of conducting suction injection, the expansion device 14*b* is opened to a designated opening degree, and part of the medium temperature and medium pressure gas-liquid two-phase refrigerant branched at the branching unit 27*b* is made to flow into the suction injection pipe 4*c* via the branch pipe 4*d*. The medium temperature and medium pressure refrigerant flowing into the suction injection pipe 4*c* is depressurized by the expansion device 14*b* to become a low temperature and low pressure gas-liquid two-phase refrigerant (point K in FIG. 10), and flows into a refrigerant pipe joining the compressor 10 and the accumulator 19.

Meanwhile, the remaining medium temperature and medium pressure gas-liquid two-phase refrigerant branched at the branching unit 27*b* is depressurized by the expansion device 14*a* to become a low pressure gas-liquid two-phase refrigerant, and additionally flows into the heat source side heat exchanger 12 which acts as an evaporator, becoming a low temperature and low pressure gas-liquid two-phase refrigerant. After that, the low temperature and low pressure gas-liquid two-phase refrigerant flows into the accumulator 19.

The low temperature and low pressure gas-liquid two-phase refrigerant flowing out from the suction injection pipe 4*c* merges with the low temperature and low pressure gas-liquid two-phase refrigerant flowing out from the accumulator 19 at a refrigerant pipe 4 connected on the suction side of the compressor 10 (point H in FIG. 10), and is suctioned into the compressor 10. The low temperature and low pressure gas-liquid two-phase refrigerant is heated and evaporated by the hermetically sealed container and motor of the compressor 10, becomes a low temperature and low pressure gas refrigerant at a lower temperature than in the case of not conducting injection, is suctioned into the compression chamber of the compressor 10, and is once again discharged from the compressor 10 (point I in FIG. 10).

Note that in the case of not conducting injection, the expansion device 14*b* closes, and the medium temperature and medium pressure gas-liquid two-phase refrigerant that passed through the branching unit 27*b* is depressurized by the expansion device 14*a* to become a low pressure gas-liquid two-phase refrigerant, flows into the heat source side heat exchanger 12, which functions as an evaporator, to become a low temperature and low pressure gas-liquid two-phase refrigerant, and is suctioned into the compressor 10 via the accumulator 19 (point F in FIG. 10). This low temperature and low pressure gas-liquid two-phase refrigerant is heated and evaporated by the hermetically sealed container and motor of the compressor 10, becomes a low temperature and low pressure gas refrigerant at a higher temperature than in the case of conducting injection, is suctioned into the compression chamber of the compressor 10, and is once again discharged from the compressor 10 (point G in FIG. 10).

In addition, the temperature of refrigerant discharged from the compressor 10 in the case of conducting injection (point I in FIG. 10) lowers with respect to the temperature of refrigerant discharged from the compressor 10 in the case of not conducting injection (point G in FIG. 10). In this way, even if the air conditioning apparatus 100 implements a refrigerant whose temperature of discharge from the compressor 10 reaches a high temperature (such as R32, for example), it is possible to lower the discharge temperature of the compressor 10, and improve the operating stability of the air conditioning apparatus 100.

Note that the opening/closing device 24 closes, preventing the refrigerant in a high pressure state from the branching unit 27*a* from mixing with the refrigerant in a medium pressure state coming via the backflow prevention device 20. Also, if the expansion device 14*a* is controlled such that the medium pressure detected by the medium pressure detection device 32 becomes a constant value, control of the temperature of discharge from the expansion device 14*b* stabilizes. Furthermore, the opening degree (expansion amount) of the expansion device 14*b* is controlled such that the discharge temperature of the compressor 10 detected by the discharge refrigerant temperature detection device 37 does not become too high.

Also, in the heating main operating mode, it is necessary to cool heat medium in the intermediate heat exchanger 15*b*, and the pressure of refrigerant on the upstream side of the expansion device 14*a* (medium pressure) cannot be set very high. If medium pressure cannot be set high, the flow rate of refrigerant to inject on the suction side of the compressor 10 decreases, and the discharge temperature is not lowered as much. However, this is not problematic. Since it is necessary to prevent freezing of the heat medium, it may be configured such that the system does not enter the heating main operating mode when the outside air temperature is low (for example, when the outside air temperature is −5 degrees C. or less). When the outside temperature is high, the discharge temperature is not very high, and the flow rate of suction injection does not need to be very large. With the expansion device 14*a*, cooling of the heat medium in the intermediate heat exchanger 15*b* is also possible, and the medium pressure can be set to enable a supply a suction injection flow rate that is sufficient to lower the discharge temperature. Thus, safer operation is possible.

Next, the flow of heat medium in the heat medium circuit B will be described. In the heating main operating mode, the heating energy of the refrigerant is transferred to the heat medium in the intermediate heat exchanger 15*b*, and the heated heat medium is made to flow inside the pipes 5 by the pump 21*b*. Also, in the heating main operating mode, the cooling energy of the refrigerant is transferred to the heat medium in the intermediate heat exchanger 15*a*, and the cooled heat medium is made to flow inside the pipes 5 by the pump 21*a*. Outflowing heat medium pressurized by the pump 21*a* and the pump 21*b* flows into the use side heat exchanger 26*a* and the use side heat exchanger 26*b* via the second heat medium flow switching device 23*a* and the second heat medium flow switching device 23*b*.

In the use side heat exchanger 26*b*, the heat medium takes away heat from the indoor air, thereby cooling the indoor space 7. Also, in the use side heat exchanger 26*a*, the heat medium transfer away heat to the indoor air, thereby heating the indoor space 7. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium with slightly raised temperature passing through the use side heat exchanger 26*b* goes through the heat medium flow control device 25*b* and the first heat medium flow switching device 22*b*, flows into the intermediate heat exchanger 15*a*, and is once again suctioned into the pump 21*a*. The heat medium with slightly lowered temperature passing through the use side heat exchanger 26*a* goes through the heat medium flow control device 25*a* and the first heat medium flow switching device 22*a*, flows into the intermediate heat exchanger 15*b*, and is once again suctioned into the pump 21*b*.

Meanwhile, the warm heat medium and the cool heat medium is introduced into use side heat exchangers 26 having a heating load and a cooling load, respectively, and due to the action of the first heat medium flow switching devices 22 and the second heat medium flow switching devices 23, the heat medium does not mix. Note that inside the pipes 5 of the use side heat exchangers 26, on both the heating side and the cooling side, the heat medium flows in the direction going from the second heat medium flow switching devices 23 to the first heat medium flow switching devices 22 via the heat medium flow control devices 25. In addition, the air conditioning load required in the indoor space 7 may be covered by control to keep the difference between the temperature detected by the first temperature sensor 31*b* versus the temperature detected by the second temperature sensors 34 at a target value on the heating side, while keeping the difference between the temperature detected by the second temperature sensors 34 versus the temperature detected by the first temperature sensor 31*a* at a target value on the cooling side.

When executing the heating main operating mode, it is not necessary for the heat medium to flow to use side heat exchangers 26 with no heat load (including those switched off by thermostat control). For this reason, the heat medium is made to not flow to the use side heat exchangers 26 by closing channels with the heat medium flow control devices 25. In FIG. 9, heat medium is flowing through the use side heat exchanger 26*a* and the use side heat exchanger 26*b* because a heat load exists, but since there is no heat load on the use side heat exchanger 26*c* and the use side heat exchanger 26*d*, the heat medium flow control device 25*c* and the heat medium flow control device 25*d* are fully closed. Furthermore, in the case where a heat load is generated from the use side heat exchanger 26*c* or the use side heat exchanger 26*d*, the heat medium flow control device 25*c* or the heat medium flow control device 25*d* may be opened to allow the circulation of heat medium.

[Advantageous Effects of Air Conditioning Apparatus 100 According to Embodiment 1]

The air conditioning apparatus 100 according to Embodiment 1 is able to inject refrigerant into the suction side of the compressor 10, and thus is able to moderate decreases in operating stability.

Also, the air conditioning apparatus 100 according to Embodiment 1 is able to conduct injection in the heating only operating mode, the cooling only operating mode, the heating main operating mode, and the cooling main operating mode. In other words, the air conditioning apparatus 100 is able to conduct injection even if the flow of refrigerant changes, such as by switching from cooling operation to heating operation or cooling and heating mixed operation or the like, for example.

Furthermore, the air conditioning apparatus 100 according to Embodiment 1 enables injection with the addition of an improvement to the refrigerant circuit in the outdoor unit 1 and the heat medium relay unit 3. In other words, the air conditioning apparatus 100 is capable of injection even without a configuration such as one that provides a check valve or the like in the indoor units 2, thus improving versatility.

[Refrigerant Pipes 4]

The outdoor unit 1 and the heat medium relay unit 3 are connected by refrigerant pipes 4, and refrigerant flows through the refrigerant pipes 4.

[Pipes 5]

The heat medium relay unit 3 and the indoor units 2 are connected by (heat medium) pipes 5, and a heat medium such as water or antifreeze flows through the pipes 5.

Also, in the air conditioning apparatus 100, in the case where only a heating load or a cooling load is generated in the use side heat exchangers 26, the corresponding first heat medium flow switching devices 22 and the second heat medium flow switching devices 23 may be set to intermediate opening degrees to allow heat medium to flow through both the intermediate heat exchanger 15*a* and the intermediate heat exchanger 15*b*. This configuration enables the use of both the intermediate heat exchanger 15*a* and the intermediate heat exchanger 15*b* for heating operation or cooling operation, thereby increasing the heat transfer area and enabling efficient heating operation or cooling operation to be conducted.

Also, in the case where a mixed heating and cooling load is generated in the use side heat exchangers 26, the first heat medium flow switching devices 22 and the second heat medium flow switching devices 23 corresponding to the use side heat exchangers 26 conducting heating operation switch to a channel connected to the intermediate heat exchanger 15*b* used for heating, while the first heat medium flow switching devices 22 and the second heat medium flow switching devices 23 corresponding to the use side heat exchangers 26 conducting cooling operation switch to a channel connected to the intermediate heat exchanger 15*a* used for cooling. In so doing, each indoor unit 2 is able to freely conduct heating operation and cooling operation.

Note that any device is applicable as the first heat medium flow switching devices 22 and the second heat medium flow switching devices 23 as long as they are devices able to switch channels, such as devices able to switch among a three-way passage such as three-way valves, or a combination of two opening and closing valves or other devices that open and close a two-way passage. In addition, devices are applicable if they are able to vary the flow rate in a three-way passage such as a mixing valve driven by a stepping motor, or a combination of two devices able to vary the flow rate in a two-way passage such as an electronic expansion valve, may be used as the first heat medium flow switching devices 22 and the second heat medium flow switching devices 23. In this case, it is also possible to prevent a water hammer caused by the sudden opening or closing of a channel. Furthermore, although Embodiment 1 describes as an example the case where the heat medium flow control devices 25 are two-way valves, the heat medium flow control devices 25 may also be control valves having a three-way passage, and may be installed together with bypass pipes that bypass the use side heat exchangers 26.

Also, besides a device able to vary an aperture area such as an electronic expansion valve, an opening and closing valve such as a compact solenoid valve, a capillary tube, a compact check valve or the like may also be used as the expansion device 14*a*. Any device able to form medium pressure is sufficient.

Also, the heat medium flow control devices 25 may use a device driven by a stepping motor and able to control the flow rate flowing through a channel, and may also be a two-way valve or a three-way valve with one end sealed. Moreover, a device such as an opening and closing valve that opens and closes a two-way passage may be used as the heat medium flow control devices 25, with the average flow rate controlled by repeatedly switching the valve on and off.

In addition, although the second refrigerant flow switching devices 18 are illustrated like four-way valves, the configuration is not limited thereto, and refrigerant may be made to flow in the same way by using multiple two-way channel switching valves or three-way channel switching valves.

Also, a similar effect is obviously achieved even in the case where only one use side heat exchanger 26 and heat medium flow control device 25 are connected. In addition, installing multiple intermediate heat exchangers 15 and expansion devices 16 that work in the same way obviously poses no problems. Furthermore, although the case of the heat medium flow control devices 25 being housed inside the heat medium relay unit 3 is described as an example, the configuration is not limited thereto, and the heat medium flow control devices 25 may also be housed inside the indoor units 2, or configured separately from the heat medium relay unit 3 and the indoor units 2.

For the heat medium, substances such as brine (antifreeze), water, a mixture of brine and water, or a mixture of water and a highly anticorrosive additive may be used. Consequently, the air conditioning apparatus 100 contributes to improved safety even if the heat medium leaks into the indoor space 7 via the indoor units 2, because a highly safe substance is used for the heat medium.

For the refrigerant, the effects of suction injection are large when using a refrigerant with a higher discharge temperature such as R32. Besides R32, a refrigerant mixture (zeotropic refrigerant mixture) of R32 and a tetrafluoropropene-based refrigerant with a low global warming potential such as HFO-1234yf expressed by the chemical formula CF3CF═CH2 or HFO-1234ze expressed by the chemical formula CF3CH═CHF may be used.

In the case of using R32 as the refrigerant, the discharge temperature rises approximately 20 degrees C. compared to the case of using R410A in the same operating state, thus requiring usage while lowering the discharge temperature, and the advantageous effects of suction injection are large. For a refrigerant mixture of R32 and HFO-1234yf, in the case where the R32 mass ratio is 62% or greater, the discharge temperature rises 3 degrees C. or more over the case of using R410A, and thus the advantageous effects are large if the discharge temperature is lowered by suction injection. Also, for a refrigerant mixture of R32 and HFO-1234ze, in the case where the R32 mass ratio is 43% or greater, the discharge temperature rises 3 degrees C. or more over the case of using R410A, and thus the advantageous effects are large if the discharge temperature is lowered by suction injection.

Also, the refrigerant types in the refrigerant mixture are not limited to these, and a refrigerant mixture containing small quantities of other refrigerant components does not largely affect the discharge temperature, and exhibits similar advantageous effects. For example, a refrigerant mixture of R32 and HFO-1234yf that also contains small quantities of other refrigerants may still be used.

In addition, although fans are typically installed in the heat source side heat exchanger 12 and the use side heat exchangers 26*a* to 26*d* to promote condensation or evaporation by blowing air, the configuration is not limited thereto. For example, devices such as panel heaters utilizing radiation may also be used as the use side heat exchangers 26*a* to 26*d*, while a water-cooled device that moves heat with water or antifreeze may be used as the heat source side heat exchanger 12. Any device may be used insofar as the device has a structure enabling heat to be given off or taken way.

Also, although the description herein takes the case of four use side heat exchangers 26*a* to 26*d* as an example, any number thereof may be connected.

In addition, although the case of two intermediate heat exchangers 15*a* and 15*b* is described as an example, the configuration is obviously not limited thereto, and any number of intermediate heat exchangers 15 may be installed insofar as the configuration enables the cooling and/or heating of heat medium.

In addition, the pumps 21*a* and 21*b* are not limited to one each, and multiple low-capacity pumps may also be arranged in parallel.

Also, in Embodiment 1, an exemplary configuration like the following is described. Namely, there is described, as an example, a system in which a compressor 10, a four-way valve (first refrigerant flow switching device) 11, a heat source side heat exchanger 12, an expansion device 14*a*, an expansion device 14*b*, opening/closing devices 17, and a backflow prevention device 20 are housed in an outdoor unit 1. Also, use side heat exchangers 26 are housed in indoor units 2, while intermediate heat exchangers 15 and expansion devices 16 are housed in a heat medium relay unit 3. Furthermore, the outdoor unit 1 and the heat medium relay unit 3 are interconnected by a pair of pipes, with refrigerant circulated between the outdoor unit 1 and the heat medium relay unit 3, while the indoor units 2 and the heat medium relay unit 3 are interconnected by respective pairs of pipes, with heat medium circulated between the indoor units 2 and the heat medium relay unit 3. Heat is exchanged between the refrigerant and the heat medium at the intermediate heat exchangers 15. However, the air conditioning apparatus 100 is not limited thereto. For example, it is also possible to apply the present invention to, and exhibit similar advantageous effects with, a direct expansion system in which the compressor 10, the four-way valve (first refrigerant flow switching device) 11, the heat source side heat exchanger 12, the expansion device 14*a*, the expansion device 14*b*, the opening/closing devices 17, and the backflow prevention device 20 are housed in the outdoor unit 1, load side heat exchangers, which exchange heat between the air of an air-conditioning target space and the refrigerant, and the expansion devices 16 are housed in the indoor units 2. A relay unit formed separately from the outdoor unit 1 and the indoor units 2 is provided, with the outdoor unit 1 and the relay unit interconnected by a pair of pipes, and with the indoor units 2 and the relay unit interconnected by respective pairs of pipes. Refrigerant is circulated between the outdoor unit 1 and the indoor units 2 via the relay unit, enabling cooling only operation, heating only operation, cooling main operation, and heating main operation to be conducted.

Also, in Embodiment 1, an exemplary configuration like the following has been described. Namely, there has been described, as an example, a system in which a compressor 10, a four-way valve (first refrigerant flow switching device) 11, a heat source side heat exchanger 12, an expansion device 14*a*, and an expansion device 14*b* are housed in an outdoor unit 1. Also, use side heat exchangers 26 are housed in indoor units 2. Furthermore, intermediate heat exchangers 15 and expansion devices 16 are housed in a heat medium relay unit 3, and the outdoor unit 1 and the heat medium relay unit 3 are interconnected by a pair of pipes, with refrigerant circulated between the outdoor unit 1 and the heat medium relay unit 3, while the indoor units 2 and the heat medium relay unit 3 are interconnected by respective pairs of pipes, with heat medium circulated between the indoor units 2 and the heat medium relay unit 3. Heat is exchanged between the refrigerant and the heat medium at the intermediate heat exchangers 15. However, the air conditioning apparatus 100 is not limited thereto.

For example, it is also possible to apply the present invention to, and exhibit similar advantageous effects with, a direct expansion system in which the compressor 10, the four-way valve (first refrigerant flow switching device) 11, the heat source side heat exchanger 12, the expansion device 14*a*, and the expansion device 14*b* are housed in the outdoor unit 1, while load side heat exchangers, which exchange heat between the air of an air-conditioning target space and the refrigerant, and the expansion devices 16 are housed in the indoor units 2. Multiple indoor units are connected to the outdoor unit 1 by pairs of pipes, and refrigerant is circulated between the outdoor unit 1 and the indoor units 2, enabling cooling operation and heating operation to be conducted.

Also, although an air conditioning apparatus capable of performing cooling and heating mixed operation, such as cooling main operation and heating main operation, is described as an example herein, the configuration is not limited thereto. The present invention may also be applied to, and similar advantageous effects exhibited with, an air conditioning apparatus unable to conduct cooling and heating mixed operation that switches between cooling only operation and heating only operation. Also, among apparatus that are unable to conduct cooling and heating mixed operation, there are included those with just one intermediate heat exchanger.

Embodiment 2

Figure 12:
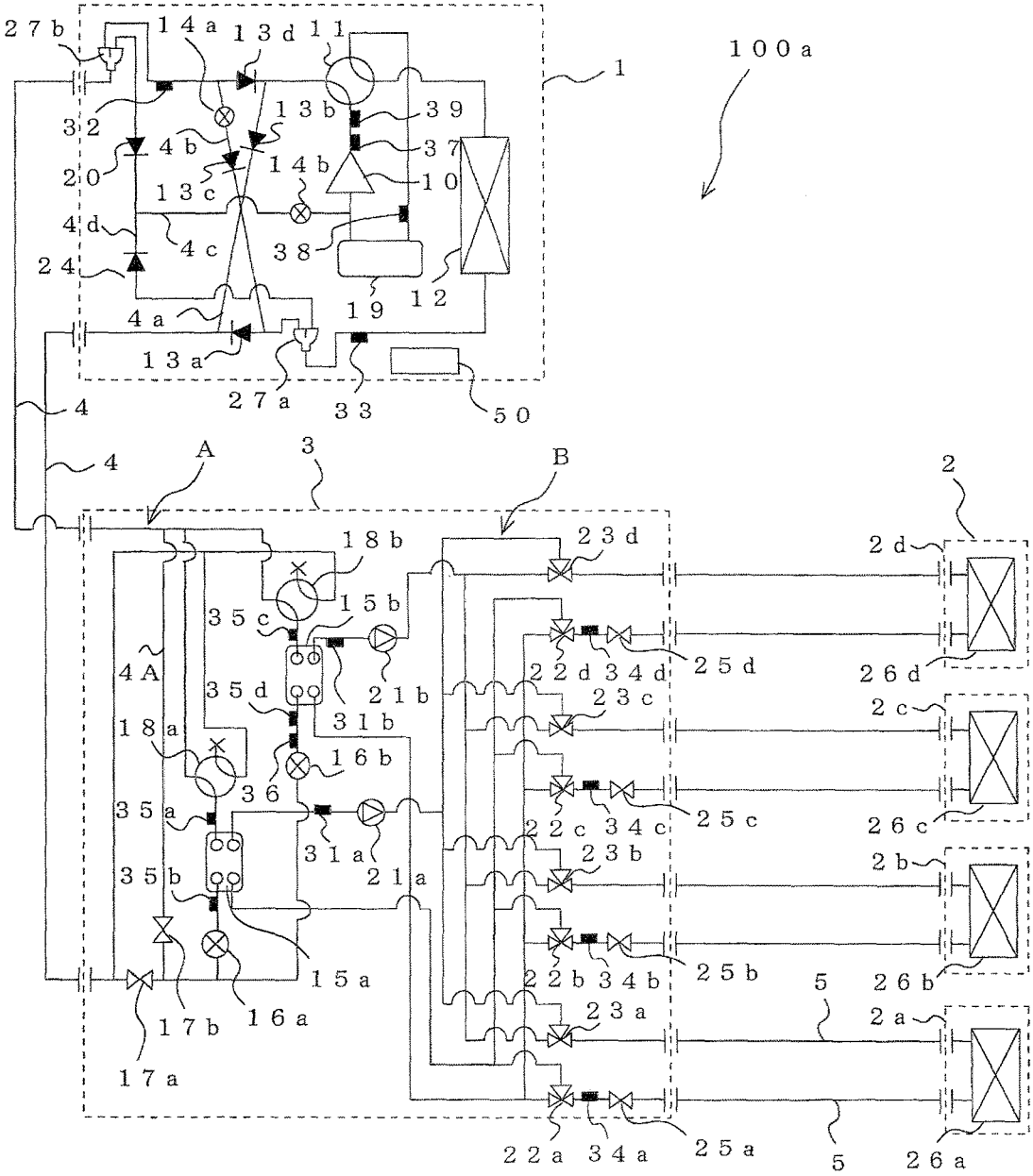
FIG. 12 is an exemplary circuit layout of an air conditioning apparatus according to Embodiment 2 of the present invention.

Embodiment 2 of the present invention will be described on the basis of the drawings. The present embodiment is a modification of part of the refrigerant circuit in Embodiment 1, and most portions are the same as Embodiment 1. Only the portions that differ from Embodiment 1 will be described. FIG. 12 is an exemplary circuit layout of an air conditioning apparatus (hereinafter designated the air conditioning apparatus 100*a*) according to Embodiment 2. A detailed configuration of the air conditioning apparatus 100*a* will be described on the basis of FIG. 12.

The air conditioning apparatus 100*a* includes a refrigerant circuit A, which is a refrigeration cycle that circulates refrigerant, as well as a heat medium circuit B that circulates head medium. Each of the indoor units 2 is able to select between cooling operation and heating operation. Similarly to the air conditioning apparatus 100 according to Embodiment 1, the air conditioning apparatus 100*a* according to Embodiment 2 is able to conduct a cooling only operating mode, a heating only operating mode, and cooling and heating mixed operating modes. Note that the cooling only operating mode, the heating only operating mode, the cooling main operating mode, and the heating main operating mode from among the cooling and heating mixed operating modes will be described in detail with the description of FIGS. 13 to 16.

[Outdoor Unit 1]

The first point in which the outdoor unit 1 according to Embodiment 2 illustrated in FIG. 12 differs from the outdoor unit 1 according to Embodiment 1 illustrated in FIG. 2 is that the installation position of the branching unit 27*a* according to Embodiment 1 is changed. Also, the second point of difference is that a backflow prevention device 24 is provided instead of the opening/closing device 24 according to Embodiment 1. Note that along with the change in the position of the branching unit 27*a*, the connection position between the branch refrigerant temperature detection device 33 and the branch pipe 4*d* is changed in the outdoor unit 1 according to Embodiment 2. Otherwise, the configuration is the same as Embodiment 1. By changing the installation position of the branching unit 27*a* like in Embodiment 2, it is possible to replace the opening/closing device 24 with a backflow prevention device 24 and configure the air conditioning apparatus 100*a* at low cost, while still exhibiting the same advantageous effects.

The branching unit 27*a* has three connecting ports. The connecting port on the refrigerant inflow side during cooling only operation and cooling main operation (hereinafter also designated the first connecting port) is connected to a pipe leading to the heat source side heat exchanger 12. The connecting port on the refrigerant inflow side during heating only operation and heating main operation (hereinafter also designated the second connecting port) is connected to a pipe leading to the refrigerant pipes 4 via the check valve 13*a*. The remaining connecting port (hereinafter also designated the third connecting port) is connected to the branch pipe 4*d* via the backflow prevention device 24. In other words, the connection relationships of the branching unit 27*a* is similar to the branching unit 27*a* in Embodiment 1, with the exception of the connection relationship with the check valve 13*a*.

More specifically, the first connecting port communicates with a pipe connected to the heat source side heat exchanger 12. Additionally, the first connecting port is on the downstream side of the heat source side heat exchanger 12 in the refrigerant flow direction during cooling only operation and cooling main operation. Meanwhile, the second connecting port communicates with a pipe on the side of the check valve 13*a* and a pipe on the side of the check valve 13*c*. Additionally, the second connecting port is on the downstream side of the check valve 13*c* in the refrigerant flow direction during heating only operation and heating main operation. Furthermore, the third connecting port communicates with the branch pipe 4*d* connected to the backflow prevention device 24. Additionally, the third connecting port is on the upstream side of the backflow prevention device 24 in the refrigerant flow direction during cooling only operation and cooling main operation.

Note that the whereas the branching unit 27*a* according to Embodiment 1 is placed such that refrigerant flows out from the same direction irrespective of operating mode, the branching unit 27*a* according to Embodiment 2 is placed such that the outflow direction of refrigerant is reversed between the cooling only operating mode and the cooling main operating mode, and the heating only operating mode and the heating main operating mode.

Liquid refrigerant or gas-liquid two-phase refrigerant flows into the branching units 27, depending on the operating mode of the air conditioning apparatus 100. For example, in the case of the cooling only operating mode, liquid refrigerant flows into the branching unit 27*a*, and gas refrigerant flows into the branching unit 27*b*. In the case of the cooling main operating mode, gas-liquid two-phase refrigerant flows into the branching unit 27*a*, while gas refrigerant flows into the branching unit 27*b*. In the case of the heating only operating mode and the heating main operating mode, gas-liquid two-phase refrigerant flows into the branching unit 27*a* and the branching unit 27*b*. Accordingly, when gas-liquid two-phase refrigerant flows into the branching units 27, in the case where even division of flow is required, the branching unit 27*a* is placed in a direction such that refrigerant branches in two after the refrigerant flows from bottom to top. The branching of the two-phase refrigerant in the branching unit 27*a* is only for the case of the cooling main operating mode. In the case of the cooling main operating mode, it is sufficient for the refrigerant to branch in two after flowing from bottom to top. In the case of the heating only operating mode and the heating main operating mode, two-phase refrigerant flows into the branching unit 27*a*, but since one of the three channels is closed by the backflow prevention device 24, refrigerant flows so as to enter from one channel and leave by a separate channel, without being branched into two channels. In other words, in the case of the heating only operating mode and the heating main operating mode in Embodiment 2, outflowing refrigerant is not split in two, and thus it is not problematic for the refrigerant to flow from top to bottom (the reverse direction with respect to the direction of gravity) in the branching unit 27*a*.

The backflow prevention device 24 opens and closes the channel between the branching unit 27*a* and the suction injection pipe 4*c*. The opening/closing device 24 is a check valve, for example, and automatically opens and closes the channel, with the channel entering an open state when the pressure on the inlet side of the backflow prevention device 24 is higher than the pressure on the outlet side, and the channel closing when the pressure on the inlet side of the backflow prevention device 24 is lower than the pressure on the outlet side. In the case of the cooling only operating mode and the cooling main operating mode, high pressure refrigerant flows into the branching unit 27*a*. If the expansion device 14*b* is opened in order to conduct injection, the pressure on the inlet side of the backflow prevention device 24 (the branching unit 27*a* side) is higher than the pressure on the outlet side of the backflow prevention device 24 (the outlet side of the backflow prevention device 20 and also the inlet side of the expansion device 14*b*). Thus, a flow proceeding from the side of the branching unit 27*a* to the side of the backflow prevention device 24 and the expansion device 14*b* is produced. On the other hand, in the case of not conducting injection, if the expansion device 14*b* is closed, the refrigerant has nowhere to flow, and thus the flow proceeding from the side of the branching unit 27*a* to the side of the opening/closing device 24 is stopped. Additionally, in the heating only operating mode and the heating main operating mode, low pressure refrigerant flows into the branching unit 27*a*, and thus the pressure (low pressure) on the inlet side of the backflow prevention device 24 (the branching unit 27*a* side) becomes lower than the pressure (medium pressure) on the outlet side of the backflow prevention device 24 (the outlet side of the backflow prevention device 20 and also the inlet side of the expansion device 14*b*). Thus, flow via the backflow prevention device 24 is not produced.

The branch refrigerant temperature detection device 33 detects the temperature of refrigerant flowing into the branching unit 27*a* in the case of the cooling only operating mode and the cooling main operating mode, and is provided in the channel on the inflow side of the branching unit 27*a* in the cooling only operating mode and the cooling main operating mode.

The branch pipe 4*d* is a pipe for leading refrigerant to the suction injection pipe 4*c* in the case of injection into the compressor 10. The branch pipe 4*d* is connected to the branching unit 27*a*, the branching unit 27*b*, and the suction injection pipe 4*c*. The backflow prevention device 20 and the backflow prevention device 24 are provided on the branch pipe 4*d*.

[Cooling Only Operating Mode]

Figure 13:
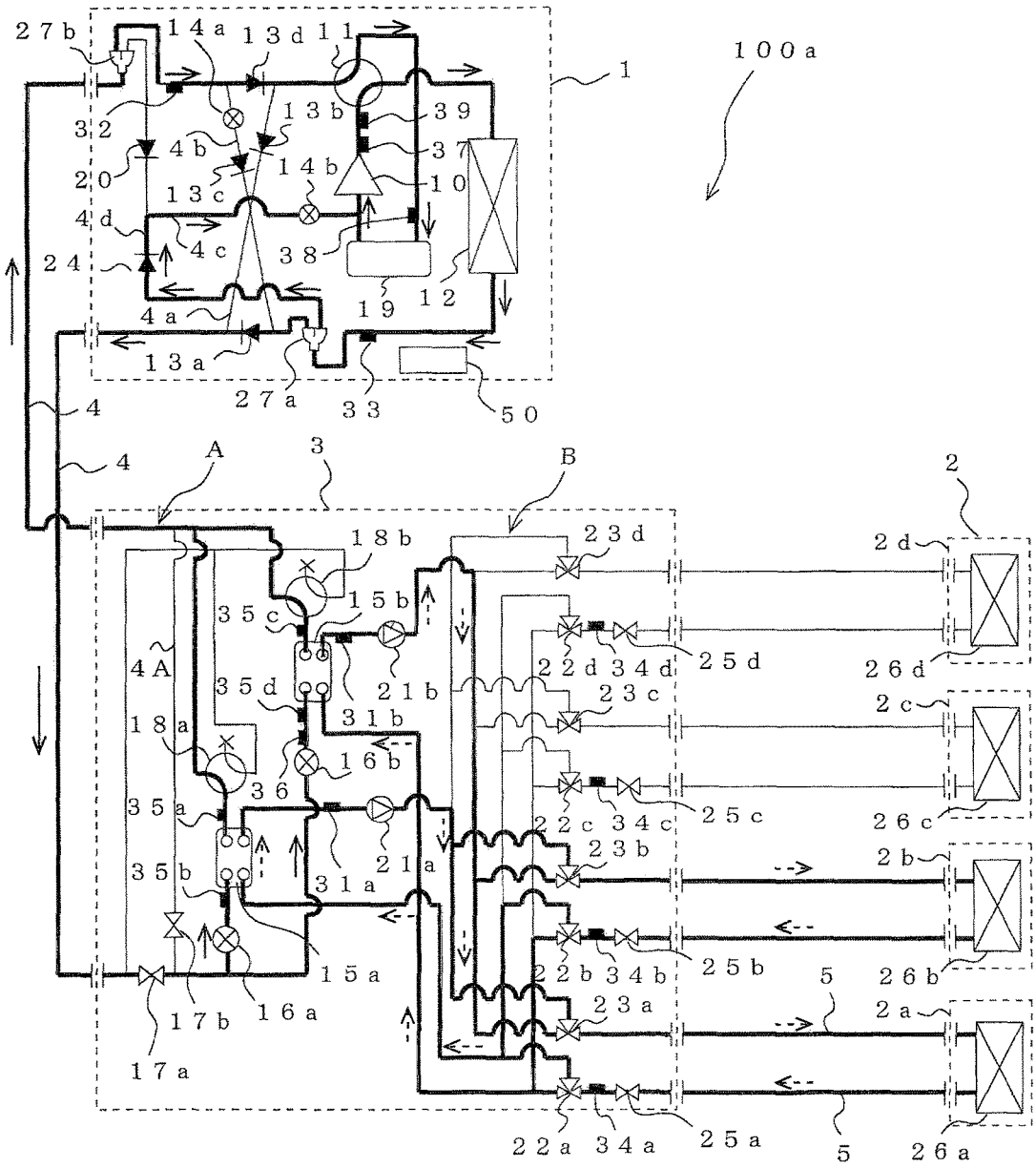
FIG. 13 is a diagram explaining the flow of refrigerant and heat medium during cooling only operation of the air conditioning apparatus illustrated in FIG. 12.

FIG. 13 is a diagram explaining the flow of refrigerant and heat medium during cooling only operation of the air conditioning apparatus 100*a* illustrated in FIG. 12. On the basis of FIG. 13, cooling only operation of the air conditioning apparatus 100*a* will be described, taking only the points that differ from cooling only operation of the air conditioning apparatus 100 in FIG. 3 of Embodiment 1.

The flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 flows into the heat source side heat exchanger 12 via the first refrigerant flow switching device 11. Then, the refrigerant condenses and liquefies while transferring heat to the outside air in the heat source side heat exchanger 12, and becomes high pressure gas-liquid two-phase refrigerant. The high pressure gas-liquid two-phase refrigerant flowing out from the heat source side heat exchanger 12 goes through the branching unit 27*a* and the check valve 13*a*, flows out from the outdoor unit 1, and goes through the refrigerant pipes 4 to flow into the heat medium relay unit 3. After passing through the opening/closing device 17*a*, the high pressure gas-liquid two-phase refrigerant flowing into the heat medium relay unit 3 is branched and expanded by the expansion device 16*a* and the expansion device 16*b* to become a low temperature and low pressure two-phase refrigerant.

The two-phase refrigerant respectively flows into the intermediate heat exchanger 15*a* and the intermediate heat exchanger 15*b* which act as evaporators, and evaporates to become low temperature and low pressure gas refrigerant while cooling the heat medium by taking away heat from the heat medium circulating through the heat medium circuit B. The gas refrigerant flowing out of the intermediate heat exchanger 15*a* and the intermediate heat exchanger 15*b* flows out from the heat medium relay unit 3 via the second refrigerant flow switching device 18*a* and the second refrigerant flow switching device 18*b*, and passes through the refrigerant pipes 4 to once again flow into the outdoor unit 1. The refrigerant flowing into the outdoor unit 1 passes through the check valve 13*d* via the branching unit 27*b*, and is once again suctioned into the compressor 10 via the first refrigerant flow switching device 11 and the accumulator 19.

[Cooling Only Operating Mode p-h Chart]

The p-h chart (pressure-enthalpy chart) for the cooling only operation illustrated in FIG. 13 is the same as FIG. 4 of Embodiment 1. Injection operations in this mode will be described with FIG. 13 and the p-h chart in FIG. 4. Refrigerant suctioned into the compressor 10 and compressed by the compressor 10 is condensed in the heat source side heat exchanger 12 to become high pressure liquid refrigerant (point J in FIG. 4). This high pressure liquid refrigerant reaches the branching unit 27*a*.

In the case of conducting injection, if the expansion device 14*b* is opened, the pressure on the inlet side of the backflow prevention device 24 (the branching unit 27*a* side) is higher than the pressure on the outlet side of the backflow prevention device 24 (the outlet side of the backflow prevention device 20 and also the inlet side of the expansion device 14*b*). Thus, a flow from the branching unit 27*a* via the backflow prevention device 24 is produced, and part of the high pressure liquid refrigerant branched at the branching unit 27*a* is made to flow into the suction injection pipe 4*c* via the backflow prevention device 24 and the branch pipe 4*d*. The high pressure liquid refrigerant flowing into the suction injection pipe 4*c* is depressurized by the expansion device 14*b* to become a low temperature and low pressure gas-liquid two-phase refrigerant (point K in FIG. 4), and flows into a refrigerant pipe joining the compressor 10 and the accumulator 19. Meanwhile, the remaining high pressure liquid refrigerant branched at the branching unit 27*a* flows into the heat medium relay unit 3 via the check valve 13*a*, is depressurized by the expansion devices 16 to become a low pressure gas-liquid two-phase refrigerant, and additionally flows into the intermediate heat exchangers 15 which function as evaporators, becoming a low temperature and low pressure gas-liquid two-phase refrigerant. After that, the low temperature and low pressure gas-liquid two-phase refrigerant flows into the outdoor unit 1, and flows into the accumulator 19.

The low temperature and low pressure gas-liquid two-phase refrigerant flowing out from the suction injection pipe 4*c* merges with the low temperature and low pressure gas refrigerant flowing out from the accumulator 19 at a refrigerant pipe 4 connected on the suction side of the compressor 10 (point H in FIG. 4), and is suctioned into the compressor 10. The low temperature and low pressure gas-liquid two-phase refrigerant generated by this convergence is heated and evaporated by the hermetically sealed container and motor of the compressor 10, becomes a low temperature and low pressure gas refrigerant at a lower temperature than in the case of not conducting injection, is suctioned into the compression chamber of the compressor 10, and is once again discharged from the compressor 10 (point I in FIG. 4).

Note that in the case of not conducting injection, if the expansion device 14*b* is closed, the refrigerant has nowhere to flow, and thus the flow via the backflow prevention device 24 is stopped, and the high pressure liquid refrigerant going through the branching unit 27*a* and flowing out from the outdoor unit 1 is depressurized by the expansion devices 16 to become a low pressure gas-liquid two-phase refrigerant, flows into the intermediate heat exchangers 15, which function as evaporators, to become a low temperature and low pressure gas refrigerant, and is suctioned into the compressor 10 via the accumulator 19 (point F in FIG. 4). This low temperature and low pressure gas refrigerant is heated and evaporated by the hermetically sealed container and motor of the compressor 10, becomes a low temperature and low pressure gas refrigerant at a higher temperature than in the case of conducting injection, is suctioned into the compression chamber of the compressor 10, and is once again discharged from the compressor 10 (point G in FIG. 4).

Note that the refrigerant in the channel from the backflow prevention device 24 in the branch pipe 4*d* to the backflow prevention device 20 is high pressure refrigerant, whereas the refrigerant which returns to the outdoor unit 1 from the heat medium relay unit 3 via the refrigerant pipes 4 and reaches the branching unit 27*b* is low pressure refrigerant. Due to the action of the backflow prevention device 20, the high pressure refrigerant in the branch pipe 4*d* is prevented from mixing with the low pressure refrigerant in the branching unit 27*b*. The flow of heat medium in the heat medium circuit B is the same as in FIG. 3 of Embodiment 1, and further description will be omitted.

[Heating Only Operating Mode]

Figure 14:
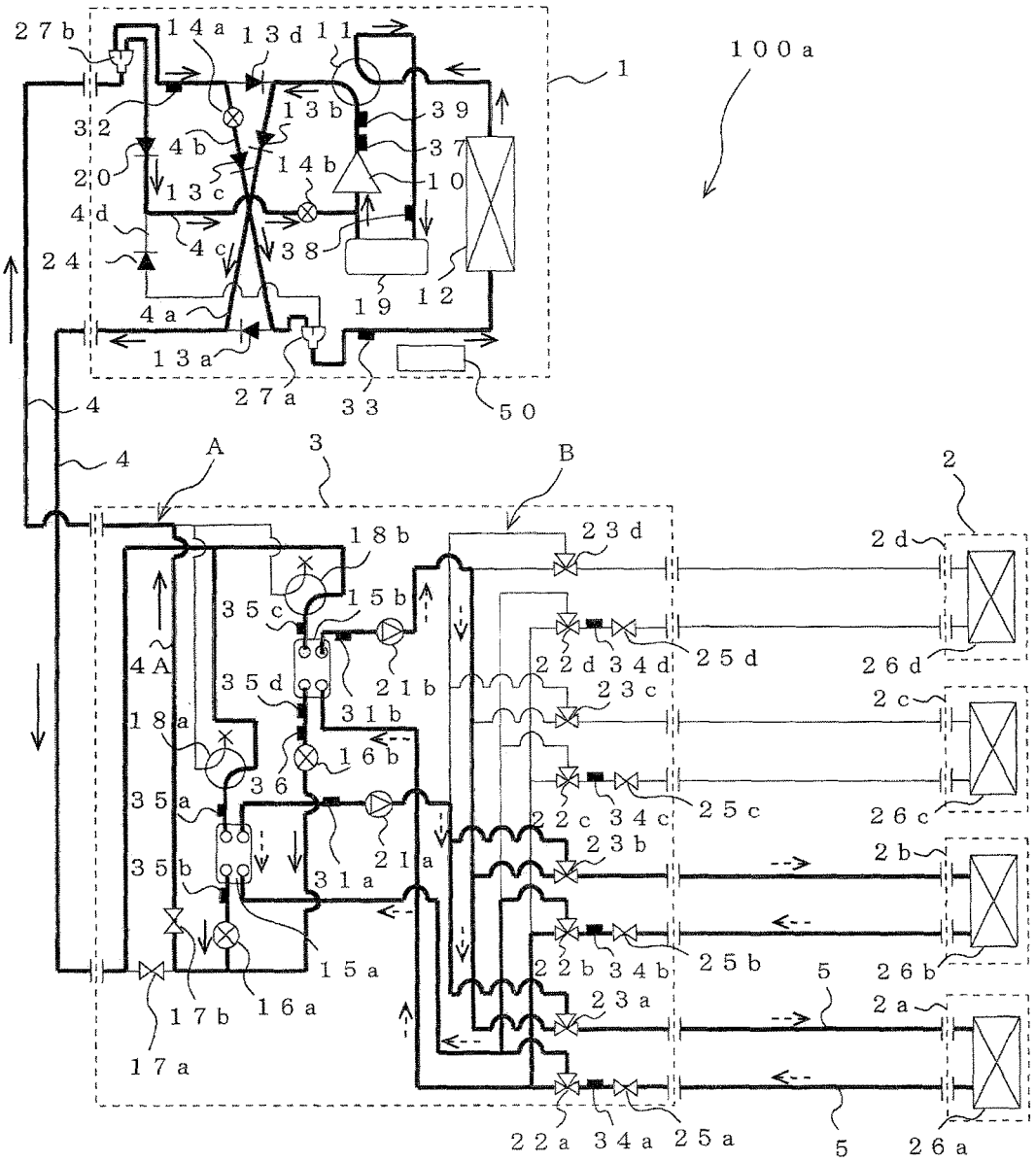
FIG. 14 is a diagram explaining the flow of refrigerant and heat medium during heating only operation of the air conditioning apparatus illustrated in FIG. 12.

FIG. 14 is a diagram explaining the flow of refrigerant and heat medium during heating only operation of the air conditioning apparatus 100*a* illustrated in FIG. 12. On the basis of FIG. 14, heating only operation of the air conditioning apparatus 100*a* will be described, taking only the points that differ from heating only operation of the air conditioning apparatus 100 in FIG. 5 of Embodiment 1.

The flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 goes through the first refrigerant flow switching device 11, is conducted through the first connecting pipe 4*a*, passes through the check valve 13*b*, and flows out from the outdoor unit 1. The high temperature and high pressure gas refrigerant flowing out of the outdoor unit 1 flows into the heat medium relay unit 3 via the refrigerant pipes 4. The high temperature and high pressure gas refrigerant flowing into the heat medium relay unit 3 is branched, goes through the second refrigerant flow switching device 18*a* and the second refrigerant flow switching device 18*b*, and respectively flows into the intermediate heat exchanger 15*a* and the intermediate heat exchanger 15*b*.

The high temperature and high pressure gas refrigerant flowing into the intermediate heat exchanger 15*a* and the intermediate heat exchanger 15*b* condenses and liquefies to become high pressure gas-liquid two-phase refrigerant while transferring heat to the heat medium circulating through the heat medium circuit B. The gas-liquid two-phase refrigerant flowing out of the intermediate heat exchanger 15*a* and the intermediate heat exchanger 15*b* is expanded by the expansion device 16*a* and the expansion device 16*b* to become a medium temperature and medium pressure two-phase refrigerant. This two-phase refrigerant goes through a bypass pipe 4A and the opening/closing device 17*b*, flows out from the heat medium relay unit 3, goes through the refrigerant pipes 4, and once again flows into the outdoor unit 1. The refrigerant flowing into the outdoor unit 1 flows into the second connecting pipe 4*b* via the branching unit 27*b*, goes through the expansion device 14*a*, is constricted by the expansion device 14*a* to become low temperature and low pressure two-phase refrigerant, passes through the check valve 13*c* and the branching unit 27*a*, and flows into the heat source side heat exchanger 12 which acts as an evaporator.

Then, the refrigerant flowing into the heat source side heat exchanger 12 takes away heat from the outside air at the heat source side heat exchanger 12, and becomes a low temperature and low pressure gas refrigerant. The low temperature and low pressure gas refrigerant flowing out of the heat source side heat exchanger 12 is once again suctioned into the compressor 10 via the first refrigerant flow switching device 11 and the accumulator 19.

[Heating Only Operating Mode p-h Chart]

The p-h chart (pressure-enthalpy chart) for the heating only operation illustrated in FIG. 14 is the same as FIG. 6 of Embodiment 1. Also, during heating only operation, medium pressure refrigerant branched at the branching unit 27*b* is injected on the suction side of the compressor 10, whereas refrigerant on the high pressure side is not introduced into the injection pipe via the backflow prevention device 24. Consequently, the basic operation is as described in the embodiment, and further description will be omitted.

In the heating only operating mode, low pressure refrigerant flows into the branching unit 27*a*, and thus the pressure (low pressure) on the inlet side of the backflow prevention device 24 (the branching unit 27*a* side) becomes lower than the pressure (medium pressure) on the outlet side of the backflow prevention device 24 (the outlet side of the backflow prevention device 20 and also the inlet side of the expansion device 14*b*). Thus, flow via the backflow prevention device 24 is not produced due to the action of the backflow prevention device 24, preventing the refrigerant in a high pressure state flowing through the branching unit 27*a* from mixing with the refrigerant in a medium pressure state coming via the backflow prevention device 20. The flow of heat medium in the heat medium circuit B is the same as in FIG. 5 of Embodiment 1, and further description will be omitted.

[Cooling Main Operating Mode]

Figure 15:
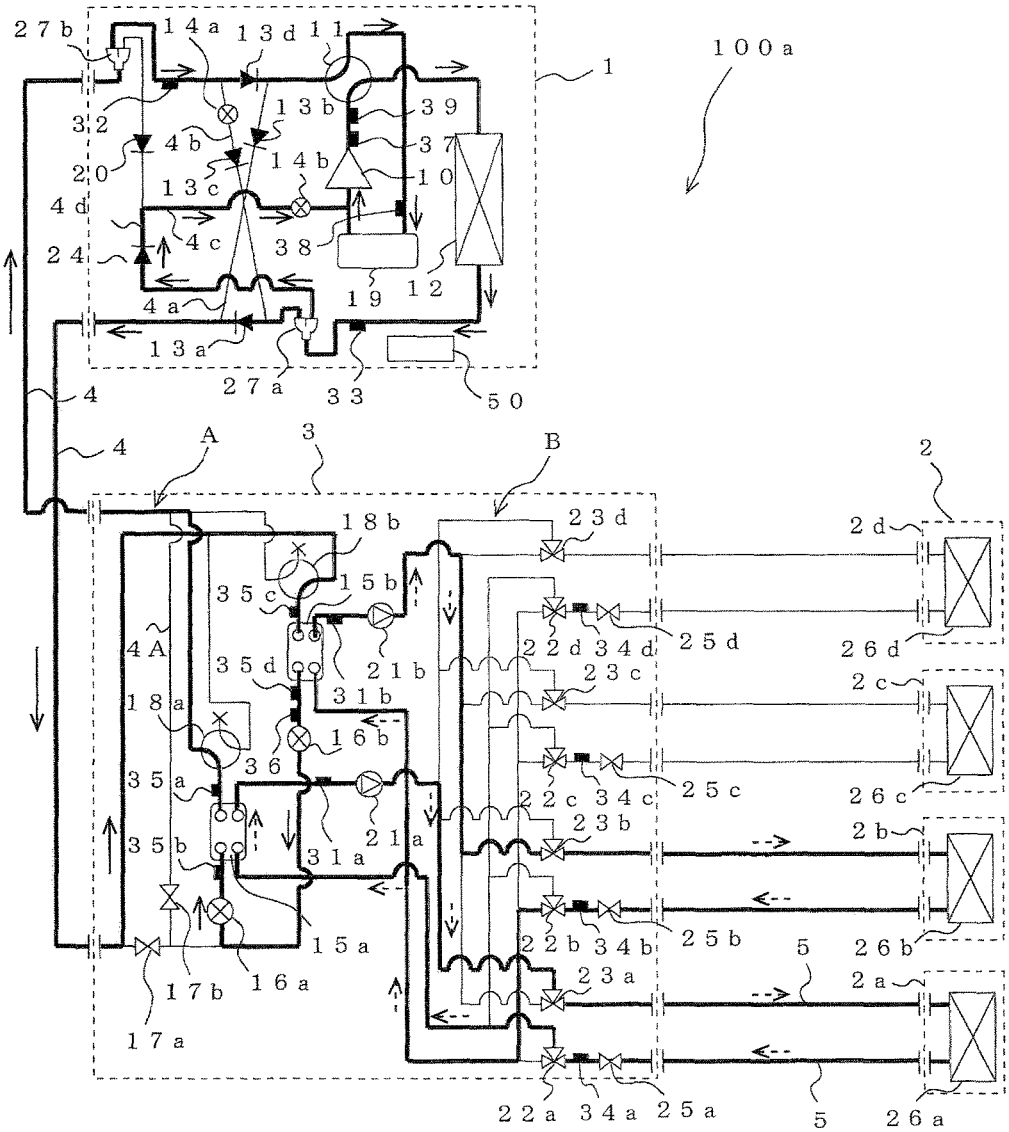
FIG. 15 is a diagram explaining the flow of refrigerant and heat medium during cooling main operation of the air conditioning apparatus illustrated in FIG. 12.

FIG. 15 is a diagram explaining the flow of refrigerant and heat medium during cooling main operation of the air conditioning apparatus 100*a* illustrated in FIG. 12. On the basis of FIG. 15, cooling main operation of the air conditioning apparatus 100*a* will be described, taking only the points that differ from cooling main operation of the air conditioning apparatus 100 in FIG. 7 of Embodiment 1.

The flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 flows into the heat source side heat exchanger 12 via the first refrigerant flow switching device 11. The refrigerant then condenses to become two-phase refrigerant while transferring heat to the outside air in the heat source side heat exchanger 12. The two-phase refrigerant flowing out from the heat source side heat exchanger 12 passes through the branching unit 27*a* and the check valve 13*a*, flows out from the outdoor unit 1 via the branching unit 27*a*, and goes through the refrigerant pipes 4 to flow into the heat medium relay unit 3. The two-phase refrigerant flowing into the heat medium relay unit 3 goes through the second refrigerant flow switching device 18*b*, and flows into the intermediate heat exchanger 15*b* which acts as a condenser.

The two-phase refrigerant flowing into the intermediate heat exchanger 15*b* condenses and liquefies to become gas-liquid two-phase refrigerant while transferring heat to the heat medium circulating through the heat medium circuit B. The gas-liquid two-phase refrigerant flowing out of the intermediate heat exchanger 15*b* is expanded by the expansion device 16*b* to become low pressure two-phase refrigerant. This low pressure two-phase refrigerant flows via the expansion device 16*a* into the intermediate heat exchanger 15*a*, which acts as an evaporator. The low pressure two-phase refrigerant flowing into the intermediate heat exchanger 15*a* takes away heat from the heat medium circulating through the heat medium circuit B, thus becoming low pressure gas refrigerant while cooling the heat medium. This gas refrigerant flows out of the intermediate heat exchanger 15*a*, flows out of the heat medium relay unit 3 via the second refrigerant flow switching device 18*a*, and once again flows into the outdoor unit 1 via the refrigerant pipes 4. The refrigerant flowing into the outdoor unit 1 passes through the check valve 13*d* via the branching unit 27*b*, and is once again suctioned into the compressor 10 via the first refrigerant flow switching device 11 and the accumulator 19.

[Cooling Main Operating Mode p-h Chart]

The p-h chart (pressure-enthalpy chart) for the cooling main operation illustrated in FIG. 15 is the same as FIG. 8 of Embodiment 1. Injection operations in this mode will be described with FIG. 15 and the p-h chart in FIG. 8. Refrigerant suctioned into the compressor 10 and compressed by the compressor 10 is condensed in the heat source side heat exchanger 12 to become high pressure gas-liquid two-phase refrigerant (point J in FIG. 8). This high pressure gas-liquid two-phase refrigerant reaches the branching unit 27*a*.

In the case of conducting injection, if the expansion device 14*b* is opened, the pressure on the inlet side of the backflow prevention device 24 (the branching unit 27*a* side) is higher than the pressure on the outlet side of the backflow prevention device 24 (the outlet side of the backflow prevention device 20 and also the inlet side of the expansion device 14*b*). Thus, a flow from the branching unit 27*a* via the backflow prevention device 24 is produced, and part of the high pressure gas-liquid two-phase refrigerant branched at the branching unit 27*a* is made to flow into the suction injection pipe 4*c* via the backflow prevention device 24 and the branch pipe 4*d*. The high pressure gas-liquid two-phase refrigerant flowing into the suction injection pipe 4*c* is depressurized by the expansion device 14*b* to become a low temperature and low pressure gas-liquid two-phase refrigerant (point K in FIG. 8), and flows into a refrigerant pipe joining the compressor 10 and the accumulator 19. Meanwhile, the remaining high pressure gas-liquid two-phase refrigerant branched at the branching unit 27*a* flows into the heat medium relay unit 3 via the check valve 13*a*, is depressurized by the expansion devices 16 to become a low pressure gas-liquid two-phase refrigerant, and additionally flows into the intermediate heat exchangers 15 which function as evaporators, becoming a low temperature and low pressure gas-liquid two-phase refrigerant. After that, the low temperature and low pressure gas-liquid two-phase refrigerant returns to the outdoor unit 1, and flows into the accumulator 19.

The low temperature and low pressure gas-liquid two-phase refrigerant flowing out from the suction injection pipe 4*c* merges with the low temperature and low pressure gas refrigerant flowing out from the accumulator 19 at a refrigerant pipe 4 connected on the suction side of the compressor 10 (point H in FIG. 8), and is suctioned into the compressor 10. The low temperature and low pressure gas-liquid two-phase refrigerant generated by this convergence is heated and evaporated by the hermetically sealed container and motor of the compressor 10, becomes a low temperature and low pressure gas refrigerant at a lower temperature than in the case of not conducting injection, is suctioned into the compression chamber of the compressor 10, and is once again discharged from the compressor 10 (point I in FIG. 8).

Note that in the case of not conducting injection, if the expansion device 14*b* is closed, the refrigerant has nowhere to flow, and thus the flow via the backflow prevention device 24 is stopped, and the high pressure gas-liquid two-phase refrigerant going through the branching unit 27*a* and flowing out from the outdoor unit 1 flows into the expansion device 16*b* and the expansion device 16*a* via the intermediate heat exchanger 15*b* which functions as a condenser, becoming a low pressure gas-liquid two-phase refrigerant, and flows into the intermediate heat exchanger 15*a* which functions as an evaporator, becoming a low temperature and low pressure gas refrigerant. After that, the refrigerant is suctioned into the compressor 10 via the accumulator 19 (point F in FIG. 8). This low temperature and low pressure gas refrigerant is heated and evaporated by the hermetically sealed container and motor of the compressor 10, becomes a low temperature and low pressure gas refrigerant at a higher temperature than in the case of conducting injection, is suctioned into the compression chamber of the compressor 10, and is once again discharged from the compressor 10 (point G in FIG. 8).

Note that the refrigerant in the channel from the backflow prevention device 24 in the branch pipe 4*d* to the backflow prevention device 20 is high pressure refrigerant, whereas the refrigerant which returns to the outdoor unit 1 from the heat medium relay unit 3 via the refrigerant pipes 4 and reaches the branching unit 27*b* is low pressure refrigerant. Due to the action of the backflow prevention device 20, the high pressure refrigerant in the branch pipe 4*d* is prevented from mixing with the low pressure refrigerant in the branching unit 27*b*. The flow of heat medium in the heat medium circuit B is the same as in FIG. 7 of Embodiment 1, and further description will be omitted.

[Heating Main Operating Mode]

Figure 16:
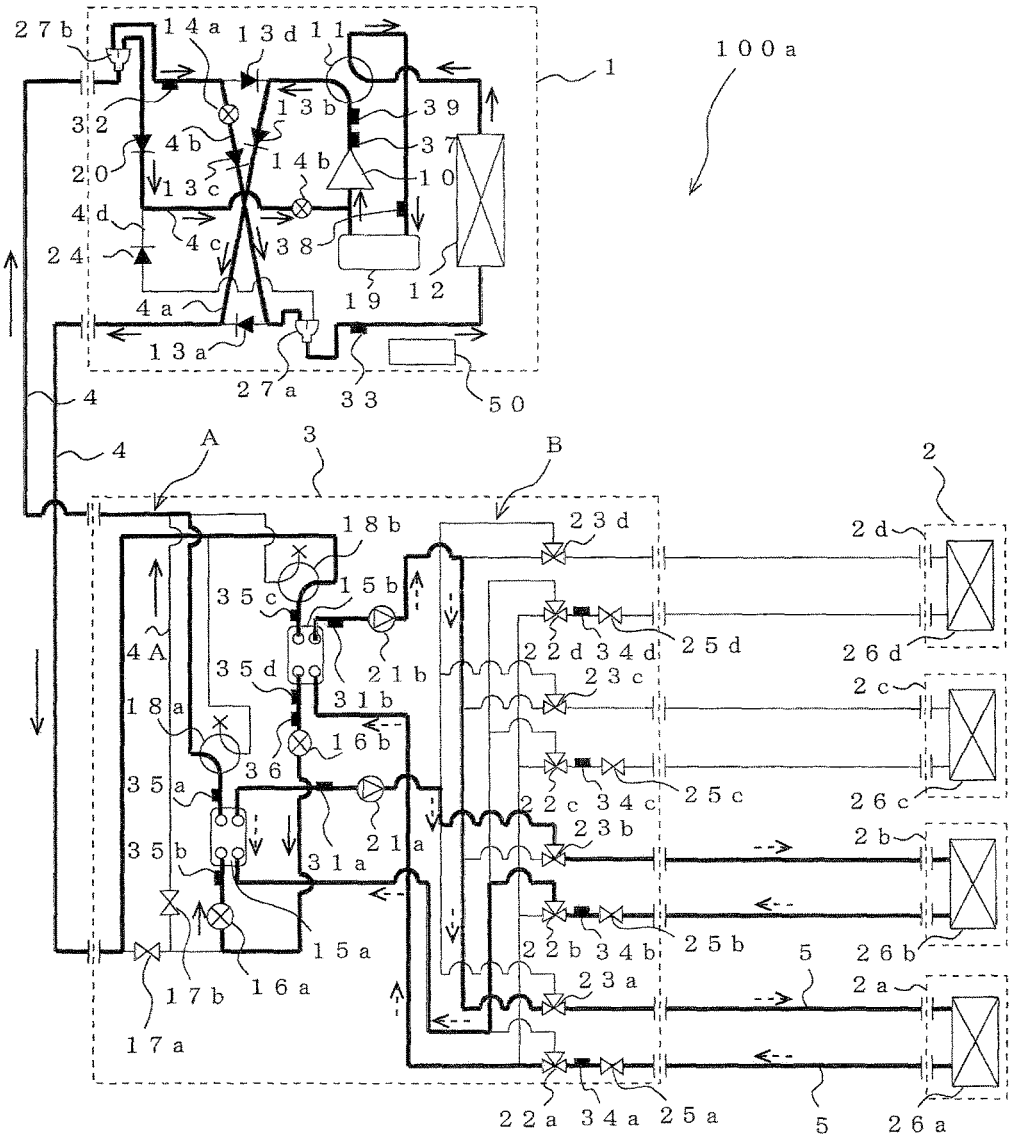
FIG. 16 is a diagram explaining the flow of refrigerant and heat medium during heating only operation of the air conditioning apparatus illustrated in FIG. 12.

FIG. 16 is a diagram explaining the flow of refrigerant and heat medium during heating only operation of the air conditioning apparatus 100*a* illustrated in FIG. 12. On the basis of FIG. 16, heating only operation of the air conditioning apparatus 100*a* will be described, taking only the points that differ from heating only operation of the air conditioning apparatus 100 in FIG. 9 of Embodiment 1.

The flow of refrigerant in the refrigerant circuit A will be described. Low temperature and low pressure refrigerant is compressed by the compressor 10 to become high temperature and high pressure gas refrigerant, and is discharged. The high temperature and high pressure gas refrigerant discharged from the compressor 10 goes through the first refrigerant flow switching device 11, is conducted through the first connecting pipe 4*a*, passes through the check valve 13*b*, and flows out from the outdoor unit 1. The high temperature and high pressure gas refrigerant flowing out of the outdoor unit 1 flows into the heat medium relay unit 3 via the refrigerant pipes 4. The high temperature and high pressure gas refrigerant flowing into the heat medium relay unit 3 goes through the second refrigerant flow switching device 18*b*, and flows into the intermediate heat exchanger 15*b* which acts as a condenser.

The gas refrigerant flowing into the intermediate heat exchanger 15*b* condenses and liquefies to become gas-liquid two-phase refrigerant while transferring heat to the heat medium circulating through the heat medium circuit B. The gas-liquid two-phase refrigerant flowing out of the intermediate heat exchanger 15*b* is expanded by the expansion device 16*b* to become medium pressure two-phase refrigerant. This medium pressure two-phase refrigerant flows via the expansion device 16*a* into the intermediate heat exchanger 15*a*, which acts as an evaporator. The medium pressure two-phase refrigerant flowing into the intermediate heat exchanger 15*a* evaporates by taking away heat from the heat medium circulating through the heat medium circuit B, thus cooling the heat medium. This low pressure two-phase refrigerant flows out of the intermediate heat exchanger 15*a*, flows out of the heat medium relay unit 3 via the second refrigerant flow switching device 18*a*, and once again flows into the outdoor unit 1 via the refrigerant pipes 4.

The refrigerant flowing into the outdoor unit 1 flows into the second connecting pipe 4*b* via the branching unit 27*b*, goes through the expansion device 14*a*, is constricted by the expansion device 14*a* to become low temperature and low pressure two-phase refrigerant, goes through the check valve 13*c* and the branching unit 27*a*, and flows into the heat source side heat exchanger 12 which acts as an evaporator. Then, the refrigerant flowing into the heat source side heat exchanger 12 takes away heat from the outside air at the heat source side heat exchanger 12, and becomes a low temperature and low pressure gas refrigerant. The low temperature and low pressure gas refrigerant flowing out of the heat source side heat exchanger 12 is once again suctioned into the compressor 10 via the first refrigerant flow switching device 11 and the accumulator 19.

[Heating Main Operating Mode p-h Chart]

The p-h chart (pressure-enthalpy chart) for the heating main operation illustrated in FIG. 16 is the same as FIG. 10 of Embodiment 1. Also, during heating main operation, medium pressure refrigerant branched at the branching unit 27*b* is injected on the suction side of the compressor 10, whereas refrigerant on the high pressure side is not introduced into the injection pipe via the backflow prevention device 24. Consequently, the basic operation is as described in the embodiment, and further description will be omitted.

In the heating main operating mode, low pressure refrigerant flows into the branching unit 27*a*, and thus the pressure (low pressure) on the inlet side of the backflow prevention device 24 (the branching unit 27*a* side) becomes lower than the pressure (medium pressure) on the outlet side of the backflow prevention device 24 (the outlet side of the backflow prevention device 20 and also the inlet side of the expansion device 14*b*). Thus, flow via the backflow prevention device 24 is not produced due to the action of the backflow prevention device 24, preventing the refrigerant in a high pressure state flowing through the branching unit 27*a* from mixing with the refrigerant in a medium pressure state coming via the backflow prevention device 20. The flow of heat medium in the heat medium circuit B is the same as in FIG. 9 of Embodiment 1, and further description will be omitted.

REFERENCE SIGNS LIST

1 outdoor unit (heat source unit) 2 indoor units 2*a* to 2*d* indoor units 3 heat medium relay unit 4 refrigerant pipes 4*a* first connecting pipe 4*b* second connecting pipe 4A bypass pipe 4*c* suction injection pipe 4*d* branch pipe 5 pipes 6 outdoor space 7 indoor space 8 space 9 structure 10 compressor 11 first refrigerant flow switching device (four-way valve) 12 heat source side heat exchanger (first heat exchanger) 13*a* to 13*d* check valves 14 expansion devices 14*a* expansion device (third expansion device) 14*b* expansion device (second expansion device) 15 intermediate heat exchangers (second heat exchangers) 15*a*, 15*b* intermediate heat exchanger (second heat exchanger) 16 expansion devices 16*a*, 16*b* expansion device (first expansion device) 17 opening/closing devices 17*a*, 17*b* opening/closing device 18 second refrigerant flow switching devices 18*a*, 18*b* second refrigerant flow switching device 19 accumulator 20 backflow prevention device (second conducting device) 21 pumps 21*a*, 21*b* pump 22 first heat medium flow switching devices 22*a* to 22*d* first heat medium flow switching device 23 second heat medium flow switching devices 23*a* to 23*d* second heat medium flow switching device 24 opening/closing device or backflow prevention device (first conducting device) 25 heat medium flow control devices 25*a* to 25*d* heat medium flow control device 26 use side heat exchangers 26*a* to 26*d* use side heat exchanger 27*a* branching unit (first branching unit) 27*b* branching unit (second branching unit) 31 temperature sensors 31*a*, 31*b* temperature sensor 32 medium pressure detection device 33 branch refrigerant temperature detection device 34 temperature sensors 34*a* to 34*d* second temperature sensor 35 temperature sensors 35*a* to 35*d* temperature sensor 36 pressure sensor 37 discharge refrigerant temperature detection device 38 suction refrigerant temperature detection device 39 high pressure detection device 41 inflow pipe 42 outflow pipe 43 expansion part 44 valve body 45 motor 46 mixing device 50 controller 100 air conditioning apparatus 100*a* air conditioning apparatus A refrigerant circuit B heat medium circuit

The invention claimed is:

1. An air conditioning apparatus, wherein a compressor including a compression chamber inside a hermetically sealed container thereof, a first refrigerant flow switching device, a first heat exchanger, at least one first expansion device, and at least one second heat exchanger are connected by refrigerant pipes to form a circuit constituting a refrigeration cycle, the air-conditioning apparatus comprising an accumulator for accumulating excess refrigerant provided on a channel on a suction side of the compressor, a suction injection pipe for externally introducing refrigerant in a liquid or a two-phase state into a channel between the compressor and the accumulator, and a second expansion device provided to the suction injection pipe, the air-conditioning apparatus being able to perform a heating operation, in which at least low pressure refrigerant flows into the first heat exchanger to cause it to serve as an evaporator, and high pressure refrigerant flows into some or all of the at least one second heat exchanger to cause them to serve as at least one condenser, the air conditioning apparatus comprising a third expansion device that generates a medium pressure smaller than the high pressure and larger than the low pressure during the heating operation in a channel of refrigerant from the at least one second heat exchanger to the first heat exchanger during the heating operation, and wherein a channel on an upstream side of the third expansion device and a channel on an upstream side of the second expansion device are connected during the heating operation, and the medium pressure refrigerant generated by the third expansion device during the heating operation is introduced on a suction side of the compressor via the second expansion device and the suction injection pipe.

2. The air conditioning apparatus of claim 1, wherein by action of the first refrigerant flow switching device, it is possible to switch between cooling operation, in which high pressure refrigerant flows into the first heat exchanger to cause it to serve as a condenser, and low pressure refrigerant flows into some or all of the at least one second heat exchanger to cause them to serve as at least one evaporator, and heating operation, in which low pressure refrigerant flows into the first heat exchanger to cause it to serve as an evaporator, and high pressure refrigerant flows into some or all of the at least one second heat exchanger to cause them to serve as at least one condenser, wherein during the cooling operation, the refrigerant circulates through the circuit without going through the third expansion device, and the high pressure refrigerant is introduced on a suction side of the compressor via the second expansion device and the suction injection pipe, and during the heating operation, the refrigerant circulates through the circuit by going through the third expansion device, and the medium pressure refrigerant generated by the third expansion device is introduced on a suction side of the compressor via the second expansion device and the suction injection pipe.

3. The air conditioning apparatus of claim 1, comprising a first branching unit that causes refrigerant to branch from a refrigerant channel in a case where refrigerant is flowing from the first heat exchanger to the at least one first expansion device, a second branching unit that diverts refrigerant from a refrigerant channel in a case where refrigerant is flowing from the at least one first expansion device to the first heat exchanger;

a branch pipe that connects the first branching unit and the second branching unit, with the suction injection pipe connected thereto, a first conducting device installed between the first branching unit and a joint between the branch pipe and the suction injection pipe, and a second conducting device installed between the second branching unit and the joint.

4. The air conditioning apparatus of claim 3, wherein the first conducting device is an opening/closing device that opens and closes a refrigerant channel in the branch pipe, and the second conducting device is a backflow prevention device that conducts refrigerant only in a flowing direction from the second branching unit to the suction injection pipe.

5. The air conditioning apparatus of claim 3, wherein the first branching unit is placed such that refrigerant flows in from a same direction in both cases of the cooling operation and the heating operation.

6. The air conditioning apparatus of claim 3, wherein the first branching unit and the second branching unit are placed such that a flow of refrigerant in an opposite direction with respect to a gravitational direction is formed and diverted.

7. The air conditioning apparatus of claim 3, wherein the first conducting device is a backflow prevention device that conducts refrigerant only in a flowing direction from the first branching unit to the suction injection pipe, and the second conducting device is a backflow prevention device that conducts refrigerant only in a flowing direction from the second branching unit to the suction injection pipe.

8. The air conditioning apparatus of claim 7, wherein the first branching unit is placed such that a direction of refrigerant flow into the first branching unit is reversed in direction between the case of the cooling operation and the case of the heating operation.

9. The air conditioning apparatus of claim 3, wherein during the cooling operation, the first branching unit is placed such that a flow of refrigerant in an opposite direction with respect to a gravitational direction is formed and diverted, and during the cooling operation and during the heating operation, the second branching unit is placed such that a flow of refrigerant in an opposite direction with respect to a gravitational direction is formed and diverted.

10. The air conditioning apparatus of claim 1, wherein the second expansion device is provided with a refrigerant expansion unit that varies an aperture area in a channel, and a refrigerant mixing device that mixes refrigerant in a two-phase state on a refrigerant inflow side of the refrigerant expansion unit.

11. The air conditioning apparatus of claim 1, further comprising a controller that controls the second expansion device such that either a refrigerant discharge temperature on a discharge side of the compressor, or a refrigerant discharge superheat degree computed from the refrigerant discharge temperature and a pressure on a discharge side of the compressor, approaches a target value, or is within a target range and controls a flow rate of refrigerant flowing to a suction side of the compressor via the second expansion device and the suction injection pipe.

12. The air conditioning apparatus of claim 11, further comprising a detection device that detects a pressure or a temperature of the medium pressure refrigerant, wherein the controller controls the third expansion device such that a detected pressure of the detection device or a saturation pressure of a detected temperature of the detection device, or alternatively, a detected temperature of the detection device or a saturation temperature of the detected pressure of the detection device, approaches a target value, or is within a target range.

13. The air conditioning apparatus of claim 6, wherein the compressor, the first refrigerant flow switching device, and the first heat exchanger are housed in an outdoor unit, the at least one first expansion device and the at least one second heat exchanger are housed in a relay unit, the outdoor unit and the relay unit are connected by two refrigerant pipes internally carrying the refrigerant, the relay unit and a plurality of indoor units that heat or cool air in an air-conditioning target space are connected by pipes carrying the refrigerant or a heat medium, the air-conditioning apparatus having a cooling only operating mode in which high pressure liquid refrigerant flows through one of the two refrigerant pipes while low pressure gas refrigerant flows through the other, and a heating only operating mode in which high pressure gas refrigerant flows through one of the two refrigerant pipes while medium pressure two-phase refrigerant flows through the other, and in the cooling only operating mode, the opening/closing device opens, introducing high pressure liquid refrigerant into the branch pipe from the first branching unit via the opening/closing device, while in the heating only operating mode, the opening/closing device closes, introducing medium pressure two-phase refrigerant into the branch pipe from the second branching unit.

14. The air conditioning apparatus of claim 13, further comprising an intermediate heat exchanger for heating and an intermediate heat exchanger for cooling as the at least one second heat exchanger, and further having, as operating modes, a cooling main operating mode in which high pressure two-phase refrigerant flows through one of the two refrigerant pipes while low pressure gas refrigerant flows through the other, and a heating main operating mode in which high pressure gas refrigerant flows through one of the two refrigerant pipes while medium pressure two-phase refrigerant flows through the other, wherein, when conducting operation in the cooling main operating mode, the controller opens the opening/closing device to allow high pressure two-phase refrigerant to flow into the suction injection pipe from the first branching unit via the opening/closing device, and when conducting operation in the heating main operating mode, the controller closes the opening/closing device to allow medium pressure two-phase refrigerant to flow into the suction injection pipe from the second branching unit.

15. The air conditioning apparatus of claim 7 wherein the compressor, the first refrigerant flow switching device, and the first heat exchanger are housed in an outdoor unit, the at least one first expansion device and the at least one second heat exchanger are housed in a relay unit, the outdoor unit and the relay unit are connected by two refrigerant pipes through which the refrigerant flows internally, the relay unit and a plurality of indoor units that heat or cool air in an air-conditioning target space are connected by a pipe carrying the refrigerant or a heat medium, the air-conditioning apparatus further having a cooling only operating mode in which high pressure liquid refrigerant flows through one of the two refrigerant pipes while low pressure gas refrigerant flows through the other, and a heating only operating mode in which high pressure gas refrigerant flows through one of the two refrigerant pipes while medium pressure two-phase refrigerant flows through the other, and in the cooling only operating mode, high pressure liquid refrigerant is introduced into the branch pipe from the first branching unit via the first conducting device which is a backflow prevention device, while in the heating only operating mode, medium pressure two-phase refrigerant is introduced into the branch pipe from the second branching unit.

16. The air conditioning apparatus of claim 15, further comprising an intermediate heat exchanger for heating and an intermediate heat exchanger for cooling as the at least one second heat exchanger, further having, as operating modes, a cooling main operating mode in which high pressure two-phase refrigerant flows through one of the two refrigerant pipes while low pressure gas refrigerant flows through the other, and a heating main operating mode in which high pressure gas refrigerant flows through one of the two refrigerant pipes while medium pressure two-phase refrigerant flows through the other, wherein, when conducting operation in the cooling main operating mode, the controller causes high pressure two-phase refrigerant to flow into the suction injection pipe from the first branching unit via the first conducting device which is a backflow prevention device, and when conducting operation in the heating main operating mode, the controller causes medium pressure two-phase refrigerant to flow into the suction injection pipe from the second branching unit.

17. The air conditioning apparatus of claim 1, wherein the suction injection pipe externally introduces the refrigerant in the liquid or a two-phase state directly into the channel between the compressor and the accumulator.

* * * * *